US006253504B1

(12) United States Patent
Cohen et al.

(10) Patent No.: US 6,253,504 B1
(45) Date of Patent: Jul. 3, 2001

(54) MANUFACTURING FACILITY FOR PRODUCTION OF STANDARD SIZE DWELLINGS

(75) Inventors: David Leslie Cohen, Englewood; Roger Blair Cohen, Wheat Ridge, both of CO (US)

(73) Assignee: Cohen Brothers Homes, LLC, Denver, CO (US)

( * ) Notice: Subject to any disclaimer, the term of this patent is extended or adjusted under 35 U.S.C. 154(b) by 858 days.

(21) Appl. No.: 08/970,231

(22) Filed: Nov. 14, 1997

Related U.S. Application Data

(63) Continuation of application No. 08/502,812, filed on Jul. 14, 1995, now abandoned.

(51) Int. Cl.[7] ..... E04H 5/02
(52) U.S. Cl. ..... 52/143; 52/745.2
(58) Field of Search ..... 52/79.1, 143, 169.1, 52/169.2, 745.02, 745.13, 745.2

(56) References Cited

U.S. PATENT DOCUMENTS

| | | | | |
|---|---|---|---|---|
| 3,679,177 | * | 7/1972 | Scholz | 52/79.1 X |
| 3,994,060 | | 11/1976 | van der Lely et al. . | |
| 4,110,952 | | 9/1978 | Blachura . | |
| 4,114,328 | * | 9/1978 | Lawrence | 52/79.1 |
| 4,187,659 | | 2/1980 | Blachura . | |
| 4,320,607 | * | 3/1982 | Eubank | 52/143 |
| 4,364,206 | | 12/1982 | Wybauw . | |
| 4,485,608 | | 12/1984 | Kaufman et al. . | |
| 4,501,098 | * | 2/1985 | Gregory | 52/79.1 |
| 4,546,530 | * | 10/1985 | Rizk | 52/79.1 X |
| 4,616,459 | | 10/1986 | Shubow . | |
| 4,869,036 | * | 9/1989 | Peacock | 52/79.1 X |
| 5,028,072 | * | 7/1991 | Lindsay | 52/143 X |
| 5,076,310 | * | 12/1991 | Barenburg | 52/79.1 X |
| 5,094,048 | * | 3/1992 | Woo | 52/143 |
| 5,353,558 | * | 10/1994 | Shea, Sr. et al. | 52/79.1 X |
| 5,381,633 | | 1/1995 | Hendrich . | |
| 5,402,618 | * | 4/1995 | Biffis et al. | 52/745.02 |

FOREIGN PATENT DOCUMENTS

| | | | | |
|---|---|---|---|---|
| 1398946 | | 6/1975 | (GB) . | |
| 2200383 | * | 8/1988 | (GB) | 52/79.1 |
| 5-263529 | * | 10/1993 | (JP) | 52/79.1 |

OTHER PUBLICATIONS

"Multi–Story Spacesetter Building Systems", CB–803–15, ©1986, Chief Industries, Inc. brochure.*

"Extending the Limits of Functional Buildings", CB–824–42, ©1992, Chief Industries, Inc. brochure.*

* cited by examiner

*Primary Examiner*—Carl D. Friedman
*Assistant Examiner*—Kevin D. Wilkens
(74) *Attorney, Agent, or Firm*—Duft, Graziano & Foresdt, P.C.

(57) ABSTRACT

The movable manufacturing facility brings standard size home building comprehensively within a controlled factory environment. The main structure of the movable manufacturing facility is sufficiently tall to allow assembly and movement of standard size homes within. Multiple independent production lines are established to each produce portions of the dwelling in the form of subassemblies. Finishes, cabinets, appliances, roofs, paint, etc. are installed in the partially completed dwellings prior to houses leaving the production floor. The movable manufacturing facility allows a standard size home under construction to be advanced via a transport element from one production line to the next until complete. The completed homes are subsequently transported on the transport element over a controlled access roadway to individual sites with pre-constructed foundations specifically designed to accept these standard size dwellings. The standard size house can be relocated from the transport element and placed directly onto the foundation. High capacity hoisting, such as clear span bridge cranes, are the key to material handling and transportation on the production lines in the movable manufacturing facility. A drive through alley large enough to accommodate semi-trucks with loaded trailers may be located within the main structure of the movable manufacturing facility.

44 Claims, 17 Drawing Sheets

MANUFACTURING FACILITY FOR PRODUCTION OF STANDARD SIZE DWELLINGS

CROSS-REFERENCE TO RELATED APPLICATIONS

This application is a file wrapper continuation of application Ser. No. 08/502,812, filed Jul. 14, 1995, now abandoned. This application is related to an application titled "Method of Production of Standard Size Dwellings Using a Movable Manufacturing Facility" filed on the same date as the present application.

FIELD OF THE INVENTION

This invention relates to a movable manufacturing facility that can be erected near a large housing development to efficiently manufacture standard size dwellings, substantially in their entirety, in a factory environment prior to transporting and placing these completed dwellings on pre-constructed permanent foundations. These standard size dwellings, as defined herein, have an abundance of architectural and floor plan flexibility, high volume rooms and, typically, living areas of 1,600 square feet or more on one or two levels, not including basements.

BACKGROUND OF THE INVENTION

The Housing Industry Today

The present residential construction industry can be divided into segments based on the three basic methods which are utilized to produce dwellings: manufactured or modular (manufactured), panelized or component (panelized)—with elements fabricated both on and off site, and individually built (stick-built)—with dwelling construction in-place at a specific building site. Each of these three methods have distinct advantages and disadvantages. In addition, each method is suited to produce a particular type of dwelling. A common goal of the residential construction industry is to produce quality dwellings that have broad market appeal in a cost efficient manner.

The manufactured home is built in a factory which is geographically remote from a housing development or a particular building site. The factory produced modules must be transported over public highways and roadways to a dealership or predetermined building site. The earliest of this class of homes were called mobile homes. They were, and still are, equipped with axles attached to an undercarriage framework. The typical manufactured home is built in a factory which serves a broad geographic region, ranging in size from tens or hundreds of miles in radius to several states. Because of the cost efficiencies inherent in factory production, the manufactured (and some panelized) method is successful in producing lower cost new housing typically for small size homes. A manufactured home is produced for direct sale to a customer and installation at a particular building site or it may be sold to a dealer and held in inventory for a subsequent sale and installation.

The present day manufactured home offers significant improvements over the former mobile home. A plurality of manufactured modular segments may comprise the finished home and the modules are transported from a remote factory to a dealership or destination building site. Once delivered to the final building location, the modules are joined together to form a resultant dwelling that is significantly larger than a typical 12"×70' single module manufactured home.

The major advantage of manufactured homes is the use of a factory environment. Within a factory setting, a controlled environment exists where complete, roadable dwellings are built. Factories represent a significant advantage in mass production efficiency. The advantages of a factory environment are:

- Dwellings can be produced very quickly from order to finished product.
- Foul weather has negligible impact on production.
- Construction tolerances are more precise and more controllable.
- Increased production through multiple shifts is readily achievable because the critical conditions of lighting, ventilation and air temperatures are controlled 24 hours a day.
- Non-sequential construction techniques are possible.
- A Federal (HUD) Building Code can be utilized which offers a streamlined regulatory environment since it is focused on performance standards rather than implementation standards. In addition, homes built to the HUD Building Code are less expensive to produce than stick-built homes which are built to the Uniform Building Code (UBC) or other local building codes.
- Major cost efficiencies are realized in both the quantity of labor hours necessary to build homes, and the unit cost for labor because of the use of repetitive production tasks and the ability to bulk purchase and handle materials at a fixed manufacturing location.

A method of dwelling construction which has similarities to the manufactured dwelling technology is the panelized method of construction. Panelized construction consists of a system for prefabricating walls, floors and roof components into units or sections. This method of construction is most efficient where there is a repetition of the panel types and dimensions. Panels are manufactured using a jig, into which the framing members are placed and then interconnected via nails, screws or welds. The interior and exterior sheathing, or even the complete interior or exterior finish, may be applied to the wall panel prior to the finished panel being hoisted onto the structure. Shop panelization offers numerous advantages. The panel shop provides a controlled environment where work proceeds regardless of weather conditions. The application of sheathing and finish work is easier and faster with the panels placed in a horizontal position instead of a vertical position.

With panelized construction, major components of homes are either prefabricated in a remote factory environment or at the site where, unfortunately, panel fabrication is exposed to local weather conditions. If components or panels are built in a factory, they are subsequently transported over public highways and roadways to the building site where they are hoisted into place and interconnected to form the basic dwelling structure using conventional building techniques. The panelized construction technique requires the use of hoisting equipment at the building site to handle the preassembled components and also requires that significant amounts of finish work be performed at the site to assemble components and finish construction joints between panels.

The major advantages of panelized construction are the following:

- Cost and production efficiencies of off-site factory panel fabrication.
  - Efficiencies of mass producing panels at a project location can also be realized.
  - Assembly of panels or components into finished homes is reasonably fast.
- Pre-fabricated panels for production of homes in "remote" regions can be accomplished.

The remaining category of residential housing is the stick-built house that is either custom built according to an owner's individual specifications, or as a builder's spec home, or constructed as one of a plurality of pre-existing models in a housing development. These dwellings are built in the traditional manner of using framing members (typically dimensional lumber) to fabricate the dwelling on a foundation at the building site according to a set of architectural plans. Stick-built home design differs greatly from manufactured home design. There are no architectural, structural or dimensional limitations with stick-built housing like those imposed on manufactured design by virtue of the roadway transportation limitations. Transportation over public roads involves height, width, length and weight restrictions. In stick-built construction, height, width, depth, roof pitch, roof overhang, gabled, dormered, etc. are all completely open to individual tastes limited only by the governing building code restrictions. The ability to produce standard size homes with substantial design flexibility is the reason that the majority of homes built today are stick-built homes.

Stick-built construction requires a sequenced building format, where item A must be completed before item B can begin, and in turn, item B must then be completed before item C can begin and so on. For example, the ground level walls must be completed before the second level floor can begin, and the second level walls must be completed before the second level ceiling can begin. While this method of residential home construction has worked for many years, there are inherent inefficiencies in this method that result in significant cost penalties to the home buyer.

Stick built dwellings can be built to any size or layout that is desired within the limitations of the structural capabilities of the framing material. Multi-story homes can easily be built with the architectural features, room size and layout being determined by the architect, home builder and/or owner. There are no overriding constraints imposed by a need to transport the structure over the existing public highway or roadway system. Other advantages of stick-built construction techniques are:

Ability to build a wide diversity of standard size dwellings (including single and multi-story).

Individual customization is easy.

Well known and widely accepted method of construction.

Skilled subcontractors are generally available.

Thus, it is evident that each of the above-noted methods of residential dwelling construction have certain distinct advantages, which advantages are typically intimately coupled with the type of dwelling produced by the selected method of construction.

PROBLEM—MANUFACTURED CONSTRUCTION METHODS

While manufactured, panelized and stick-built homes have many advantages in their respective market applications, each of them also has distinct disadvantages. These disadvantages form the core problems which face the housing industry today and, in particular, for the manufactured method:

Dimensional and design constraints have confined manufactured homes to a limited market segment.

The manufactured method cannot be used to build standard size homes without segmentation of the home into modules of relatively small dimensions which results in design and floor plan compromises.

The manufactured modules must be transported a significant distance from the factory to the building site, often via a dealership.

Manufactured home segments are subject to significant architectural and floor plan constraints because of the need to transport the completed modules over public highways and roadways.

There are significant size limitations in manufactured homes: single-story, 10–14 ft wide by 50–70 ft long with box-like architecture.

The cost of field mating the roadable manufactured modules and related field quality control necessary for assembly and finishing can be significant.

There is a possibility for damage to manufactured home modules during extended transport over the public highway system.

Problem—Panelized Construction Methods

There are also problems with panelized constructed homes:

Field labor is required for field assembly of panels.

Less than complete dwelling units are produced, since it is a method to produce only segments of homes.

The panelized method of construction cannot build standard size homes without segmentation of the home into modules of relatively small dimensions which results in many compromises.

The panels or components that are manufactured require major field assembly which takes a significant amount of time and are therefore exposed to local weather conditions.

The panels built in a remote plant have size limitations because of the necessity to transport these panels over public highways and roadways.

The panels must be assembled at the project site, and construction joints between the panels must be repaired and finished at the project site.

Major design constraints exist because panels must be roadable.

There is a possibility for damage to panels and components during extended transport and handling.

Problem—Stick-built Construction Methods

There are also problems in the stick-built method of dwelling construction:

Stick-built construction is inherently a sequential home building process floors are built before walls, walls before ceilings and the roof after all the other framing is completed. This is a lengthy process and therefore results in construction activity of extended duration.

Much of the work done in stick-building a dwelling is at the mercy of local weather conditions which can delay schedules and damage materials.

Bulk material delivery and handling are not possible because the materials need to be segregated for each individual home.

The materials and supplies are mostly hand carried, piece-by-piece, into and within the house during construction.

It is common to have 4 to 10 month construction schedules in stick-built construction of a dwelling.

Homes must conform to the local building codes, such as the Uniform Building Code (UBC), without any ability to build to the Federal (HUD) Building Code which would be faster, less expensive, and provide an easier regulatory environment.

The cost of labor in stick-building is high to thereby attract the necessary skill levels to widely scattered job sites.

Supervision and quality control in stick-building is non-uniform.

A significant disadvantage of the stick-built dwelling construction technique is that regardless of the size and/or complexity of the dwelling, these homes are built according to a process that is determined by both building codes and the need for efficiency of the various independent subcontractors that are engaged to construct the dwelling. In particular, each subcontractor wishes to minimize the number of times that he must visit the building site and often prefers unobstructed access to the majority of the structure with limited interference or coordination with other subcontractors. This construction process, especially early on, is highly dependent on weather conditions and can only occur during daylight hours. An interruption in the flow of construction caused by one of the subcontractors has a ripple effect in that the other subcontractors must await the completion of a particular task before they can begin their work. Therefore, while each individual subcontractor task does not necessarily take a lot of time in constructing a stick-built residential dwelling, the time intervals between the arrival of the various subcontractors and delays occasioned by weather and other subcontractor work, significantly lengthens the amount of time required to complete each dwelling. Furthermore, operating in a field environment is detrimental to maintaining the quality of the construction since it is difficult using portable hand tools to precisely cut and assemble framing material into walls and various finish elements with precise tolerances. It is often difficult in stick-built home construction to find a sufficient number of skilled workmen who can craft a residential structure of high quality at very reasonable costs. The quality suffers and there is also a significant amount of waste, since the materials must be handled at least 2–3 times between shipment from the factory or mill to being delivered to the individual job site. There is excess labor and significant breakage as a result of this repetitive handling of materials. In addition, typically there aren't people at individual job sites all day to receive materials so materials and supplies are exposed to the possibility of theft and bad weather. Surplus materials, unless they represent a significant quantity, are discarded since the value of salvaged materials does not offset the cost involved to salvage these materials.

While the stick-built residential structure is the most desirable residence for consumers because of the design flexibility, the cost benefits obtained by the factory manufacturing environment are unavailable to this type of construction method due to the size and more often than not multi-story nature of these structures.

Solution

The above described problems are solved, and a technical advance is achieved, by the movable manufacturing facility of the present invention, which is capable of efficiently producing standard size dwellings in a factory environment.

The movable manufacturing facility of the present invention, responds to the fundamental desire to maximize home building efficiency by implementing both a factory for and a method of full size dwelling construction that is of novel design. The movable manufacturing facility is capable of producing standard size dwellings and supplying them to a new community in a cost effective and time efficient manner unlike any construction method of the prior art. The reason this facility is termed "movable manufacturing facility" is that, at the end of a given project, the main structure of the movable manufacturing facility may be disassembled and transported to a new community development or remain in place and revert to a secondary use, such as a warehouse or fitness center. The movable manufacturing facility not only overcomes the problems inherent in the construction methods of the prior art, but also combines the advantages of the three methods of dwelling construction identified previously. Homes produced within the movable manufacturing facility appear to the consumer to be identical to stick-built standard size homes. These homes have substantial design and architectural flexibility, high volume rooms, modern floor-plans and significant overall living space. The homes that can be produced utilizing the movable manufacturing facility are unlike any manufactured homes produced today. These homes may include a wide diversity of standard size one and two story single family dwellings or various forms of multi-family dwellings.

The movable manufacturing facility is implemented specifically for the construction of individual new communities. The communities portrayed in this text exemplify housing needs and market demand in the United States. The movable manufacturing facility, however, has broad application worldwide. The main structure, equipment and systems comprising the movable manufacturing facility are designed to be packed into cargo containers. These cargo containers can then be shipped anywhere in the world that is accessible by ship, rail or semi-truck. If the native foreign lands don't have the essential materials and supplies to build houses, those items can also be shipped from any supplying nation directly to the location of the movable manufacturing facility. If by sea, containers can be off-loaded onto semi-trucks or rail cars, whichever can most efficiently and economically deliver directly to the movable manufacturing facility. There are no intermediate stops and therefore, no associated middlemen.

A major attribute of the movable manufacturing facility is its ability to build a huge diversity of dwelling products. The only thing required is a community of sufficient size to amortize the cost of the movable manufacturing facility. This flexibility is essential for international applications because housing design and requirements are vastly different from one region to the next. A common ingredient is that most often in bulk housing requirements, high quality, low cost homes that can be built in a timely fashion are in demand. The movable manufacturing facility uniquely satisfies this demand.

The movable manufacturing facility also has the versatility to build homes either with dimensional lumber or steel framing. Although the idea of steel may conjure up an image of a heavy or cumbersome material, the steel that is used in residential construction is just the opposite. Cold-formed, high strength, light gauge steel is lightweight, easy to handle, cost effective and a high quality alternative to traditional residential framing materials. Steel offers a strong, dimensionally stable, easy-to-work framing system. Steel members weigh as much as 60% less than wood members, therefore, foundation and even seismic loads for a dwelling can be reduced. Because of its strength, steel can span greater distances, offering larger open spaces and increased design flexibility without requiring intermediate columns or load bearing walls. In addition, steel framing accommodates all types of commonly used finished materials. Steel does not rot, shrink, swell, split, or warp, and is non-combustible. All steel products are recyclable. Framing members are manufactured with pre-punched holes for running piping and electrical wiring, minimizing preparation work for other trades.

In recent years, with the rapid escalation of lumber prices, builders have discovered that framing with steel can be less expensive than framing with lumber. While the price of traditional framing materials has been erratic and growing at a rate much faster than inflation, steel prices have typically only experienced small quarterly adjustments. There is a strong likelihood that steel framed houses will play a dominant role in the production of residential building products in the next ten years. Presently, steel is primarily used as a stick-for-stick substitute for wood, meaning that it is simply a different material used in identical methods to wood studs. Steel obviously has much more potential than this. One logical progression incorporated into the movable manufacturing facility is that steel framing studs can be continuous for two stories in house framing design. This opportunity decreases labor and materials costs while reducing overall construction time as well. Steel studs of 20 foot length are relatively easy to work with and cost effective, while this type of framing is not at all practical in wood due to the inherent length and stability limitations of lumber materials. The two story steel frame wall assemblies are used in balloon-type framing which includes integral cross-bracing to increase the shear strength of the wall subassembly in the plane of the wall surface. This strapping and bracing virtually eliminates racking of the wall subassembly, thereby resulting in a dwelling that is structurally more sound than one constructed used existing techniques.

The movable manufacturing facility is not implemented for the general manufacturing of homes to be shipped to a broad geographic region like the prior art manufactured and panelized systems. It is a specialized movable manufacturing facility erected proximate to a location where a large number of dwellings are to be built. The movable manufacturing facility may be linked to this community via a controlled access roadway, where public access can be limited and where width and height impediments may be much less restrictive than public streets. As a direct result, the primary problem involving the constraints of the public roadway infrastructure that lie between the factory and the building site for shipment of manufactured or panelized products is overcome. The movable manufacturing facility brings the factory to the building site. This opens the door to a whole new world of design and construction methodologies for factory produced homes. The overwhelming constraints imposed on home design, size, transportation concerns, etc. due to public roadway transport limitations between a remote factory and the final home site are eliminated.

The movable manufacturing facility brings standard size home building comprehensively within a controlled environment. The main structure of the movable manufacturing facility is sufficiently tall (30 to 40 feet) to allow assembly and movement of standard size homes within. Multiple independent production lines are established to each produce portions of homes. Materials and supplies can be purchased and handled by the semi-load within the movable manufacturing facility. Production lines exist within the movable manufacturing facility, each building and assembling different components for the finished housing product. All finishes, cabinets, appliances, roofs, paint, etc. are installed in the partially completed dwellings prior to houses leaving the production floor. The movable manufacturing facility allows a standard size home under construction to be advanced via a transport element from one production line to the next until complete. The completed homes are subsequently transported on the transport element over a controlled access roadway to individual sites with pre-constructed foundations specifically designed to accept these standard size dwellings. The standard size house can be relocated from the transport element and placed directly onto the foundation.

High capacity hoisting, such as clear span bridge cranes, are the key to material handling and transportation on the production lines in the movable manufacturing facility. A drive through alley large enough to accommodate semi-trucks with loaded trailers may be located within the main structure of the movable manufacturing facility. This promotes highly efficient unloading and subsequent material handling directly from bulk truck shipments to the production lines or storage areas via these high capacity hoists. The hoists can also place large rolls of carpeting, appliances, cabinets and the like directly inside the partially manufactured house to eliminate excess labor. Large single or multiple story wall panels, floor assemblies, large roof assemblies, etc. can be constructed and handled in a production setting. This is not possible with the construction methods of the prior art, principally because the factory environments are separated by public roadways. Finished components from the production lines can also be lifted from the assembly area and set directly at each components final destination in the partially completed house with the hoisting system.

The homes to be produced using the movable manufacturing facility have special design characteristics. One example is an integral base frame comprising a structural base element located at the perimeter of each home, and at the base of load bearing interior walls, which strengthens and stabilizes these standard size homes for manufacturing, transportation, placement on foundations and long-term durability. One important feature of the movable manufacturing facility is that the sequential building process necessary with the prior art of stick-built methods for producing standard size homes is now obsolete. The movable manufacturing facility promotes the concurrent assembly and construction of multiple facets of standard size dwellings: floors, walls, roofs, etc. can be built simultaneously. Construction time for standard size dwellings is shortened from the current methods of 4–10 months to the 4–25 working days achievable in the movable manufacturing facility. Further, the HUD Building Code utilized for factory produced manufactured housing may be utilized for standard size dwellings produced by the movable manufacturing facility which is another unique and cost savings characteristic. The conformation of the resultant structure to HUD building codes may obviate the need to deal with the plethora of local building inspectors and the inconsistent application of the building codes that they bring to the building process, since the HUD inspections certify that the product and process meet the HUD standards. The HUD building codes also permit the use of innovative construction techniques. These innovative construction techniques typically represent significant cost savings to the builder.

The configuration of the movable manufacturing facility in the preferred embodiment of the invention disclosed herein is a plurality of parallel oriented, juxtaposed production lines that are orthogonal to, and extend between, two parallel oriented and bounding "alleys," all of which are inside this very large movable manufacturing facility. Each of the production lines produces a large portion, if not substantially all, of a predetermined volumetric section or subassembly of the dwelling. A natural progression of the construction proceeds as the partially completed structure advances through this first orthogonal "dwelling assembly alley" from production line to production line. The second "delivery alley" is used for the delivery of raw materials via rail or truck into the confines of the movable manufacturing facility. Many, if not all of the production lines, include one or more hoisting elements, such as clear span bridge cranes that are integral to the movable manufacturing facility. These hoisting elements are used to transport bulk quantities of raw materials from the delivery vehicles, be that rail or truck, to storage areas that are integral to that production line and other storage facilities within the movable manufacturing facility, and to handle sub-assemblies in the production lines and from production line to each partially completed house.

Construction of each dwelling is initiated in the first of the orthogonal alleys, the dwelling assembly alley, which is of sufficient dimension to accommodate a standard size house, when assembled therein. A integral base frame, built in the first production line, is placed on a transport element at the intake portion of the movable manufacturing facility. This enables the dwelling, as it completes assembly at each stage of the movable manufacturing facility, to simply advance to the next production line in the movable manufacturing facility and ultimately be transported from the movable manufacturing facility to a permanent site in the vicinity of the movable manufacturing facility. The dwelling is produced on this rigid or rigidized integral base frame that substantially circumscribes the perimeter of the dwelling, and where necessary, bridges the various cross-sections thereof. This provides sufficient support to enable the entirety of the completed dwelling to be moved from a transport element onto a foundation at the building site selected for the dwelling.

The standard size dwellings produced in this movable manufacturing facility represent significant advances from what is produced by the housing industry today. It is achieved by collapsing the traditional sequential building process into a small finite number of steps, each of which is implemented in a predetermined production line of the facility somewhat independent of, yet in close coordination with, the building activity that takes place in the other production lines of the facility. This allows, for instance, a house's roof and floor to be assembled at the same time, yet on different production lines. Once individual components are pre-assembled, they are affixed, either directly or indirectly, to the rigidized integral base frame as it advances through the dwelling assembly alley. This final assembly of the housing components occurs in a very short period of time. Quality is assured by virtue of a controlled work environment within the movable manufacturing facility, factory tolerances, a streamlined, repetitive labor task assembly process, etc. The sequential, mutually exclusive and disjunct subcontractor operations of the prior art are replaced with a partitioning of the construction process to functionally complete the construction of predetermined volumetric sections of the structure at each of the production lines as the dwelling progresses through the movable manufacturing facility. Thus, wall sheathing and finishing may be started earlier than in the traditional stick-built building process while some operations, such as electrical and plumbing, can be done from the exterior of the dwelling when interior walls are in place. Each dwelling exits the movable manufacturing facility as a substantially completed "turn key" standard size dwelling ready for occupancy. These examples are indicative of a streamlined and efficiency driven approach to dwelling construction, which makes use of a factory environment to revolutionize the dwelling construction process for standard size homes.

Significant time savings can be attained since this operation is weather independent and large subassemblies can be produced, and then moved with the plurality of hoisting devices that are an integral portion of the movable manufacturing facility. Additionally, because of the large number of houses being produced utilizing the movable manufacturing facility, significant material cost savings are realized due to an ability to bulk purchase materials and supplies directly from manufacturers without mark-ups to middlemen. Since shipment is also direct from the manufacturers to the movable manufacturing facility, there is far less breakage and damage losses because material handling has correspondingly been reduced. Labor savings are achieved by the hoisting devices which enable a worker to move large quantities of raw materials from the delivery vehicles that drive through the movable manufacturing facility to storage areas integral to the production lines and hence into the shell of each dwelling being assembled. Thus, if there are N production lines in the movable manufacturing facility, N dwellings can concurrently be in the process of being assembled. The entirety of the manufacturing operation is executed within the environmentally controlled volume that is encompassed by the exterior shell of the movable manufacturing facility. The use of precision tools, preformed jigs, substantial hoisting devices and hydraulic assemblies are justified and cost-effective since large numbers of quality dwellings are being produced in a short time frame.

In order for construction to occur at this rapid pace, it is beneficial to have a fully integrated computer system. This computer system assists in the management of the tasks: purchasing, inventory, design, design changes, material take-off's, accounting, word processing, etc. With Computer Aided Design (CAD) capability, plans and plan changes can be electronically transferred directly to the production lines while automatically calculating revised materials lists and required inventory. Present inventories along with required stocking of materials and supplies for houses in the queue can effectively be accomplished using a CAD system. As each lot in the development is sold and the home buyer defines the model of the home to be placed thereon with the specific customized changes desired by the buyer, this information can be forwarded to the manufacturing facility where a computerized control system can schedule the construction of this structure, orders and coordinates the delivery of all necessary materials and, during the assembly phase of the structure, provides display information to the workers at each stage of the assembly process to indicate the specifics of this structure as defined by the initial user-provided order.

The work stations in the production lines of the movable manufacturing facility have worker productivity and favorable worker ergonomics at the forefront of design. Another advantage of the movable manufacturing facility is the systems and production line approach to building. Specific tasks are performed in each production line. With the aid of specialized equipment, worker tasks are made easier, more precise and more time efficient all at the same time. The labor force can be managed such that workers are cross-trained to enable them to be moved from one production line to the next according to need. With the benefit of a controlled environment within the main structure of the movable manufacturing facility, multiple shifts are not only possible, but easy to accommodate with equivalent productivity levels. This equates to a product of superior quality produced in less time than other construction techniques.

The use of substantial hoisting devices in the movable manufacturing facility reduces the labor content, speeds up the manufacturing process as well as enables the use of heretofore nontraditional structural concepts. One example of nontraditional construction is the use of multi-story steel framing members to produce multi-story shear panel members presently unknown in the residential construction industry. These multi-story metal or wood framing members minimize the number of junctions among elements and with their cross-bracing and inherent dimensional stability, result in a structure whose load-bearing walls have significantly greater integrity than existing stick-built methods. In addition, the tolerances are more precise and both labor and cost are significantly reduced.

The economic viability of the movable manufacturing facility is a function of the efficiency with which it can produce the residential structures, since the efficiency must offset the cost of erecting the manufacturing facility at or near a particular housing development site. It is obvious that the benefit afforded by this manufacturing facility is a function of the number of building sites being developed and the speed with which these sites can be populated with standard size residential structures. In addition, due to the speed of assembly of the residential structures using this facility, it is not inconceivable that the one facility can be shared among a plurality of builders, whose development projects are co-located or nearby in the same general location.

The movable manufacturing facility represents a radically new approach to building standard size homes on a large scale basis. The movable manufacturing facility not only overcomes the problems inherent in the construction methods of the prior art, but also combines the advantages of the three methods of dwelling construction identified previously. The result is that standard size homes can be built substantially faster, with higher quality, lesser cost and more efficiently than comparable homes built on-site by use of prior art construction methods.

DETAILED DESCRIPTION

Glossary

The terms used in this description are defined below to ensure that the proper import is ascribed to these terms and the usage of these terms is therefore unambiguous.

Movable manufacturing facility—the facility described herein which is used to produce standard size dwellings in an enclosed, climate controlled environment, which can comprise one or more enclosed structures.

Dwelling—a structure(s), typically comprising either a single family or multi-family home, which is used to house individuals.

Standard size dwelling—a dwelling which constitutes a "normal" or full size dwelling, presently produced on-site by means of stick building technology. This dwelling has an extensive range of design and floor plan flexibility and includes both one and two story single or multi-family structures.

Integral base frame—is that structural element which is integral to the base of a movable manufacturing facility produced standard size home, and provides the non-removable structural foundation upon which the vertical framing elements for the dwelling are attached. The integral base frame allows a standard size home to be created in its entirety and moved prior to being located on a permanent foundation. The integral base frame is typically provided at the base of the outside bearing perimeter walls, at interior load bearing walls, at selected other locations and may be contained within a floor subassembly.

Manufactured home—a dwelling built in a factory environment and transportable over public highways to a building site. These homes include trailer homes, modular homes and dwellings comprising a plurality of limited size segments that are transported to the building site and which may be joined together.

Panelized home—a dwelling wherein a significant number of components representing a portion of the dwelling are fabricated in a factory environment, then transported over public highways to the building site where they are assembled to form the basic structure.

Stick-built home—a dwelling built in the traditional manner of using dimensional lumber as framing members to fabricate the dwelling on a foundation at the building site according to a set of architectural plans which have available an extensive range of design and floor plan flexibility and includes both one and two story structures.

Manufacturing Facility Philosophy

Figure 1:
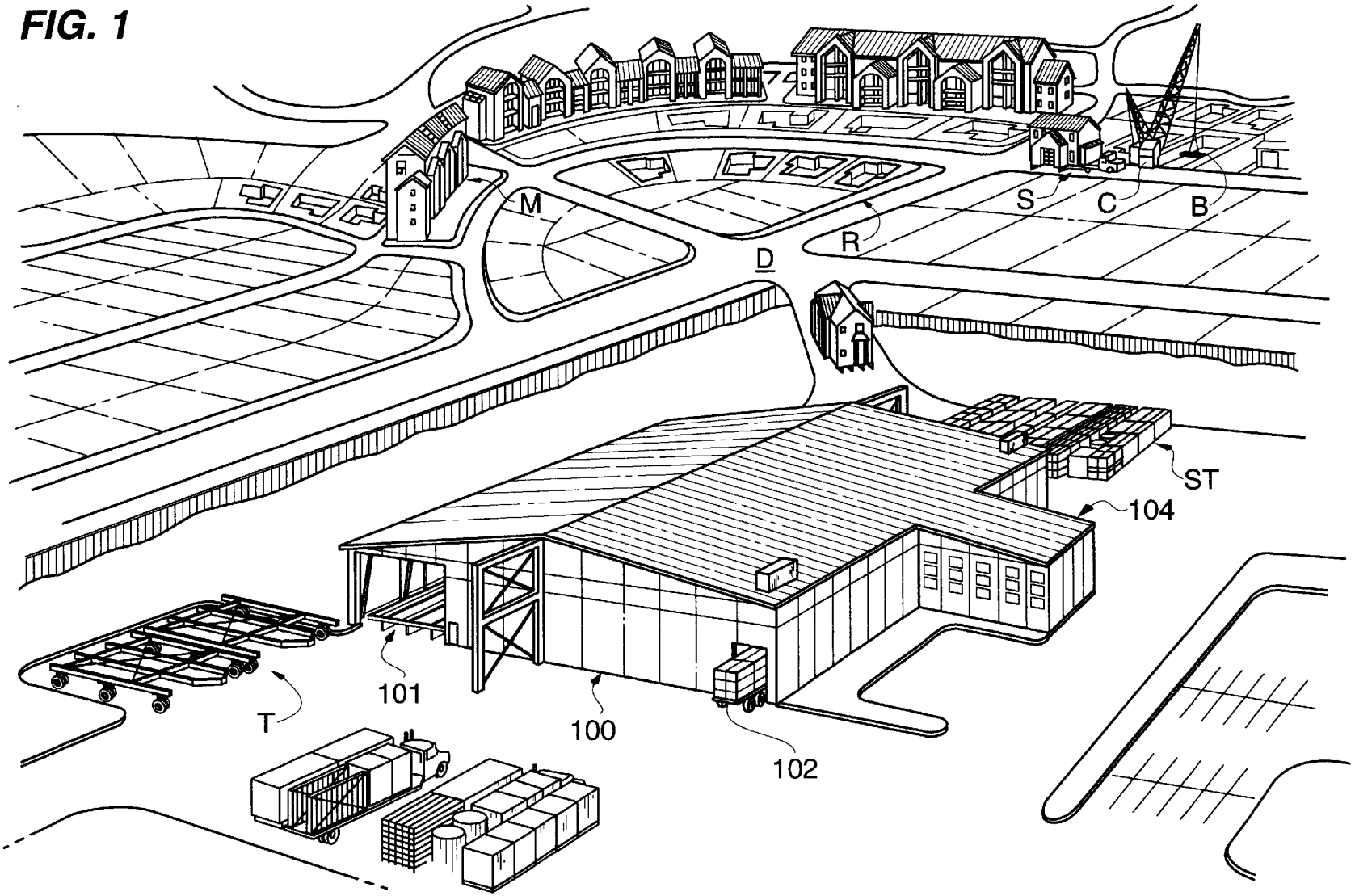
FIG. 1 illustrates a perspective view of the movable manufacturing facility sited at a residential housing development.

FIG. 1 illustrates a perspective view of the typical movable manufacturing facility 100, which is erected at a field location, proximate to a new community that is being constructed. The movable manufacturing facility 100 can be disassembled and transported via truck, and/or ship and/or rail, typically in containers for overseas application, for erection proximate to a residential housing development site. FIG. 1 depicts a variety of the dwellings which can be constructed, including single family detached homes S as well as three-story multi-family units M, to illustrate the flexibility of the production capabilities of the movable manufacturing facility 100. The multistory dwellings M can be produced as a combination of a two-story component with an overall floor area of a standard size dwelling, with a similarly sized single story component produced for the third floor and placed on top of the two-story component by a crane. As shown in FIG. 1, the movable manufacturing facility 100 is erected in close proximity to a large number of building sites B, some of which are shown in FIG. 1 as having residences sited thereon, others having foundations pre-constructed in place and others outlined as lots with no construction work having taken place.

The movable manufacturing facility 100 in the preferred embodiment disclosed herein comprises a substantially rectangular building of sufficient size to encompass the dwelling production operation and of height to provide sufficient clearance for the constructed dwelling, which is typically 30'–40' in height. The movable manufacturing facility has two large doorways in the end thereof 101, 102, with a first doorway 101 as shown in FIG. 1 being on the leftmost side of the building and used to provide transport element ingress to the movable manufacturing facility 100. A second large exterior door 102 is located on the opposite side of the end wall of the building and is used to provide ingress to delivery vehicles which are providing the raw materials to a delivery alley, located within the movable manufacturing facility, for the assembly of the residential structures that takes place within the movable manufacturing facility 100. An optional third door or doorway (not shown) can be provided substantially juxtaposed to the second door to enable a second delivery pathway for either truck traffic or rail traffic if a railroad siding is available at the site. Efficient bulk loads of materials necessary for the construction of homes are shown parked outside the movable manufacturing facility 100 in a temporary storage area ST prior to delivery into the delivery alley of the movable manufacturing facility 100 for unloading. An office structure 104 is also illustrated in a typical location on the right hand side of the movable manufacturing facility 100 although the office structure 104 need not be physically attached to the movable manufacturing facility 100 or even a permanent structure. The office structure 104 is where management, engineering, drafting, clerical and accounting personnel are located to support the manufacturing activities. As each lot in the development is sold and the home buyer defines the model of the home to be placed thereon with the specific customized features desired by the buyer, this information is forwarded to the office area 104 of the movable manufacturing facility 100 where a computerized control system schedules the construction of this dwelling, orders and coordinates the delivery of all necessary materials and, during the assembly phase of the dwelling, provides display information to the workers at each stage of the assembly process to indicate the specifics of this structure as defined by the initial user-provided order.

By collapsing the linear structure of traditional residential housing production into a substantially volumetric process, and relocating the partially completed structure from one production line of the movable manufacturing facility 100 to another, a significant amount of flexibility in the scheduling of the work can be attained by intermixing finished, roughed-in and feature work into concurrently extant operations within the same structure.

A completed standard size dwelling D can be seen in FIG. 1 departing from the movable manufacturing facility 100 through an exit door 105 (FIG. 2) located on the far side of the movable manufacturing facility 100. The exit door 105 is sized to enable the movement of the completed standard size dwelling D, mounted on the transport element to be moved from the movable manufacturing facility. FIG. 1 also illustrates a completed standard size dwelling D traversing a path through the community to a building site B that has a foundation in place and at which building site B a crane C awaits the arrival of the standard size dwelling D. When the standard size dwelling D reaches the building site B, the crane C is used to lift the completed standard size dwelling D off the transport element T and to place the structure D on the pre-existing foundation where it is secured in place. Alternatively, the pre-existing foundation can be a three-sided structure and the transport element can enter the basement area of the foundation where the transport element can be removed from under the completed dwelling as the dwelling is set on the foundation.

The transport elements T shown in FIG. 1 typically comprise a "trailer" or "frame" that is equipped with a roadable apparatus, such as sufficient number of axles and wheels to support the weight of the completed standard size dwelling D. The bed of the trailer T is of extent great enough to securely support the completed standard size dwelling D, which is built in stages on the transport element T as the transport element T is moved from the ingress doorway 101 of the movable manufacturing facility 100 to the egress doorway. A tow vehicle, such as a tractor, is used to move the transport element T and the completed standard size dwelling D from the egress doorway of the movable manufacturing facility 100 to the building site B and thence to return the transport element T to a parking area adjacent the movable manufacturing facility 100 for use in a subsequent residential structure assembly. The community can be occupied in stages as the standard size dwellings are manufactured and sited. Public access to the community is typically selected at a location distant from the movable manufacturing facility 100, such that homes are sited from this juncture incrementally to the movable manufacturing facility 100. The movable manufacturing facility 100 makes use of temporary roadways R which are restricted from public use and are available to transport the completed standard size dwellings D from the movable manufacturing facility 100 to the building site B. As sections of the roadways R are filled with completed homes, these sections can be converted from restricted/controlled access construction use to public use. The siting of the movable manufacturing facility 100 is such in the particular environment illustrated in FIG. 1 that the completed standard size dwellings D traverse roads R internal to the development and therefore do not have to contend with existing public roadways with their size and weight limitations, power lines, bridges and existing traffic. It is also possible to erect the movable manufacturing facility 100 at a site that requires the use of existing public roads, which is feasible as long as the portions of the existing roadway that are used are free of obstructions and can be monopolized during the movement of a completed standard size dwelling D.

Movable Manufacturing Facility Architecture

The economic viability of the movable manufacturing facility 100 is a function of the efficiency with which it can produce the residential structures, since the efficiency must offset the cost of erecting the movable manufacturing facility 100 at a particular housing development site. It is obvious that the benefit afforded by this movable manufacturing facility 100 is a function of the number of building sites B, the incremental cost savings associated with each unit manufactured, and the speed with which these sites can be populated with residential structures. In addition, due to the speed of assembly of the residential structures using this facility, it is not inconceivable that the one movable manufacturing facility 100 can be shared among a plurality of builders, whose development projects are co-located or nearby in the same general location. The movable manufacturing facility 100 achieves its efficiency by collapsing the linear, mutually exclusive building trades operation of the prior art into an intensive volumetric focus in the residential structure assembly process. This difference in assembly philosophy as well as the use of hoisting elements that are used in the movable manufacturing facility 100 provide the efficiencies and "automation" that assist in making this project cost-effective. Furthermore, the unique integral base frame that is used as the underpinnings of each standard size dwelling D that is assembled not only enables the completed structure to be constructed, transported, and placed by a crane C but also provides a base for the standard size dwelling D that is of greater stability and rigidity than existing methods of manufacture. Finally, the movable manufacturing facility 100, with its hoisting elements, enables the use of a variety of framing techniques and framing materials. These include western platform framing, balloon framing, the use of multi-story steel framing members and the use of full height shear panel construction techniques that are presently impractical to use in residential construction although they provide the benefits of increased structural integrity and reduced cost. Framing materials may include traditional dimension lumber, light gauge steel products, heavier red iron steel and other cold rolled steel sections.

Figure 2:
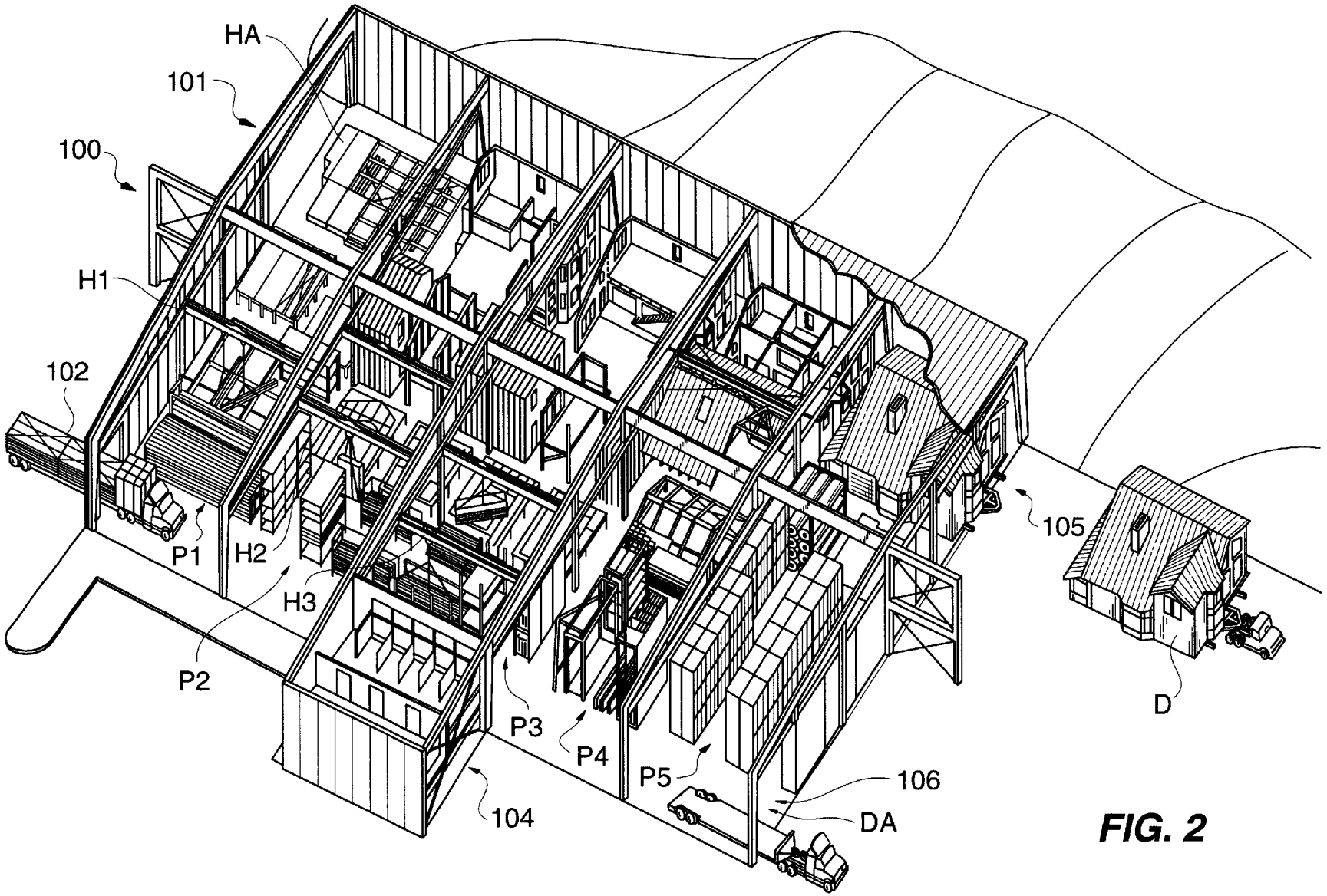
FIG. 2 illustrates a perspective view of the movable manufacturing facility with the roof removed therefrom.
Figure 3:
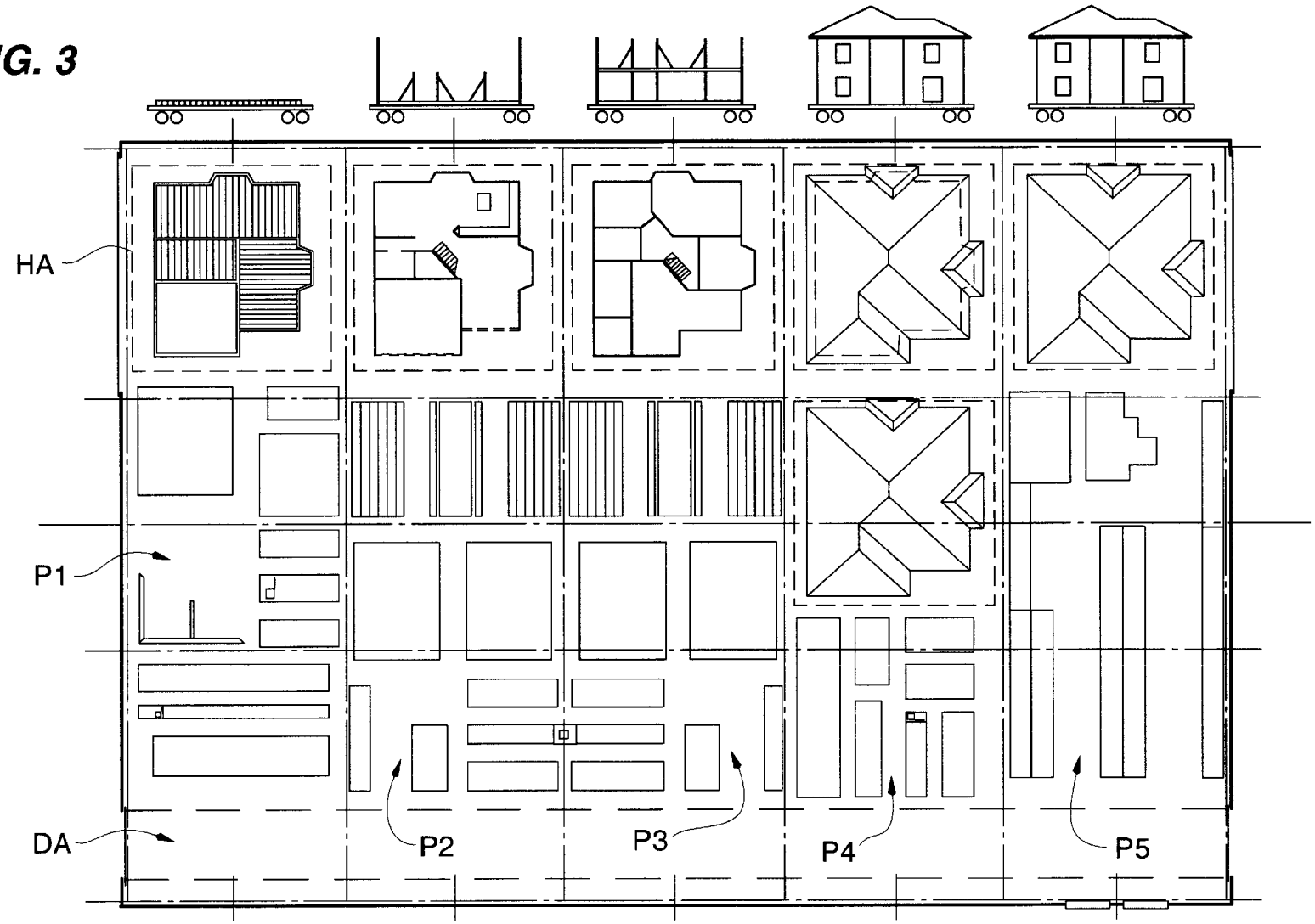
FIG. 3 illustrates in plan view a typical overall layout of the movable manufacturing facility of the present invention.

The movable manufacturing facility 100 is oriented as shown in the preferred embodiment in FIG. 2 which is a perspective view of the movable manufacturing facility 100 with the roof removed therefrom. FIG. 3 illustrates in plan view the layout of a typical movable manufacturing facility 100, with icons pictured at the top of this figure to indicate to the reader the extent of completion of a standard size dwelling D within each production line P1–P5. In this regard, the first production line P1 produces an integral base frame which is positioned on a transport element T. The second P2 and third P3 production lines build and subsequently relocate the preassembled panel subassemblies, including two-story high wall panels, onto the floor subassembly. The fourth production line P4 produces and places a full size roof subassembly onto the partitions previously produced and installed in the partially completed standard size dwelling D. FIGS. 4–13 provide detailed plan views of the movable manufacturing facility 100 that is shown in perspective view in FIG. 2.

With reference to FIG. 2 and 3, the preferred embodiment of the movable manufacturing facility 100 shows the use of a plurality of parallel oriented juxtaposed production lines P1–P5, each of which is used to create subassemblies and/or to provide warehousing of materials that are used in the construction process. Orthogonal to and aligned at one end of this plurality of production lines is a "delivery alley" DA through which the delivery vehicles pass to deliver the raw materials that are used in the standard size dwelling assembly process. The delivery alley DA typically extends the full length of the movable manufacturing facility 100 and is of sufficient dimensions that delivery vehicles can drive through the movable manufacturing facility 100 to park adjacent the production line which is the destination for the materials provided by the delivery vehicle. A hoisting element integral to that production line is then able to quickly offload the raw materials from the delivery vehicle and the delivery vehicle then exits the movable manufacturing facility 100 at an egress door 106 distal from the ingress door 102 through which it entered the movable manufacturing facility 100. Juxtaposed to and orthogonal to the plurality of production lines P1–P5 and at the end thereof opposite the delivery alley DA is a dwelling assembly alley HA wherein the raw materials and subassemblies produced in each production line are assembled in an integrated manner into the standard size dwelling D. Each production line takes raw materials and either produces subassemblies that are lifted by the hoisting elements onto the standard size dwelling D that is being assembled or provides a warehousing capability for the various raw materials that are used to create the standard size dwelling D. The specific details of each production line are described below as an illustrative embodiment with the specific implementation of each production line being a matter of design choice and somewhat dictated by the architecture of the standard size dwellings D that are being assembled in the movable manufacturing facility 100. Suffice it to say that each production line is responsible for the complete construction of a volumetric section of the standard size dwelling D or is used to complete the finished work within the standard size dwelling D that has been largely completed at the prior stages of the construction process.

It is evident that many variations of the layout illustrated in FIGS. 1–3 can be implemented, using the manufacturing techniques taught herein. For example, the production lines may be construed as encompassing the section of the delivery alley adjacent to the production line and/or the production lines may be construed as encompassing the section of the dwelling assembly alley adjacent to the production line. The production lines may not be parallel oriented, and the partially completed structure can exit a main section of the manufacturing facility to another assembly building, or another section of the manufacturing facility to have work performed thereon. Materials storage areas can also be positioned across the delivery alley, outside the manufacturing facility or in another dedicated portion of the manufacturing facility. These alternative configurations are simply obvious variants of the basic configuration disclosed herein.

In the first production line P1, a floor subassembly is produced and loaded on the transport element T. The floor subassembly includes an integral base frame which strengthens the floor subassembly to allow for the construction, transportation and setting of the standard size dwelling D on its foundation. In the second P2 and third P3 production lines, continuing to the right from the first production line P1, large wall panels are framed, sheet rocked, finished, painted and inventoried on racks prior to installation on the appropriate floor subassembly. Windows and doors are installed in the panelized wall subassemblies in the second P2 and third P3 production line. In the fourth production line P4, full size roof subassemblies are fabricated on the floor of the movable manufacturing facility 100 and then hoisted and placed on the framed partially completed standard size dwelling D by the bridge crane H4. Finish work, including panel joint finishing, cabinets, floor covering, fixtures, etc., begins in the second production line P2, continues through the fourth production line P4 and is the primary activity implemented in the fifth production line P5.

A strategic accomplishment of the movable manufacturing facility 100 is to provide a large scale factory in which multiple production lines exist and which can be utilized to produce incremental aspects of a standard size dwelling D. Some fundamental considerations are that the movable manufacturing facility 100 makes bulk materials available to all of the production lines, which capability is provided in the embodiment shown herein by the delivery alley DA, which serves all the production lines. A second consideration is that a plurality of production lines are used, each of which produces a distinct increment of the standard size dwelling D. A dwelling assembly alley HA is used to relocate the partially completed standard size dwelling D from one production line to the next sequential production line P* typically via the transport element T on which the standard size dwelling is constructed. A third consideration is the use of high capacity hoisting elements in the production lines to allow for the unloading and movement of bulk materials and for the construction and handling of large subassemblies, including the installation of the subassemblies in a partially completed standard size dwelling D.

Hoisting Elements

Efficiency of operation of the movable manufacturing facility 100 is in part achieved through the use of hoisting elements that enable the movement of large volumes of materials or large subassemblies that are efficiently produced within the movable manufacturing facility 100. The hoisting elements minimize the hand labor since they are used to pick and place raw materials, individual subassemblies, and to pre-stock materials, such as cabinets, flooring, plumbing fixtures, in the partially completed standard size dwellings. As can be seen from the perspective view of FIG. 2, the movable manufacturing facility 100 in the preferred embodiment is housed within a steel frame building that uses a plurality of steel bents to support the roof as well as the hoisting elements that are part of the movable manufacturing facility 100. The bents are aligned with the boundaries of each production line and are of sufficient structural integrity to also support the hoisting elements and the loads which they service. The bents are typically supported by a plurality of columns, located at regular intervals along the length of the bent, with a free span being provided across the width of the dwelling assembly alley HA as well as the delivery alley DA. For example, the dwelling assembly alley HA must be dimensioned to accommodate the full extent of the completely assembled standard size dwelling D. These dimensions would typically be a 30–40 foot floor to bent clearance and a support column to support column free span of approximately 60 feet. The steel bent construction specifics of such a building are well known and are not discussed in detail herein. The rails that support the hoisting elements are attached to the columns and can also be hung from the bents in the clear span area to provide support for the rails where the span between columns is greater than otherwise would be allowable for the load bearing capacity of the rails. There can be multiple hoisting elements in each production line, with the hoisting capacity of these hoisting elements being individually sized to the task being performed in the associated production line. The area of coverage by the hoisting elements within a production line can overlap so that each hoisting element has a sufficient range of travel to provide the greatest flexibility in use in that production line, thereby enabling tasks to be performed by one hoisting element when the other hoisting element is occupied performing another task.

Figure 15:
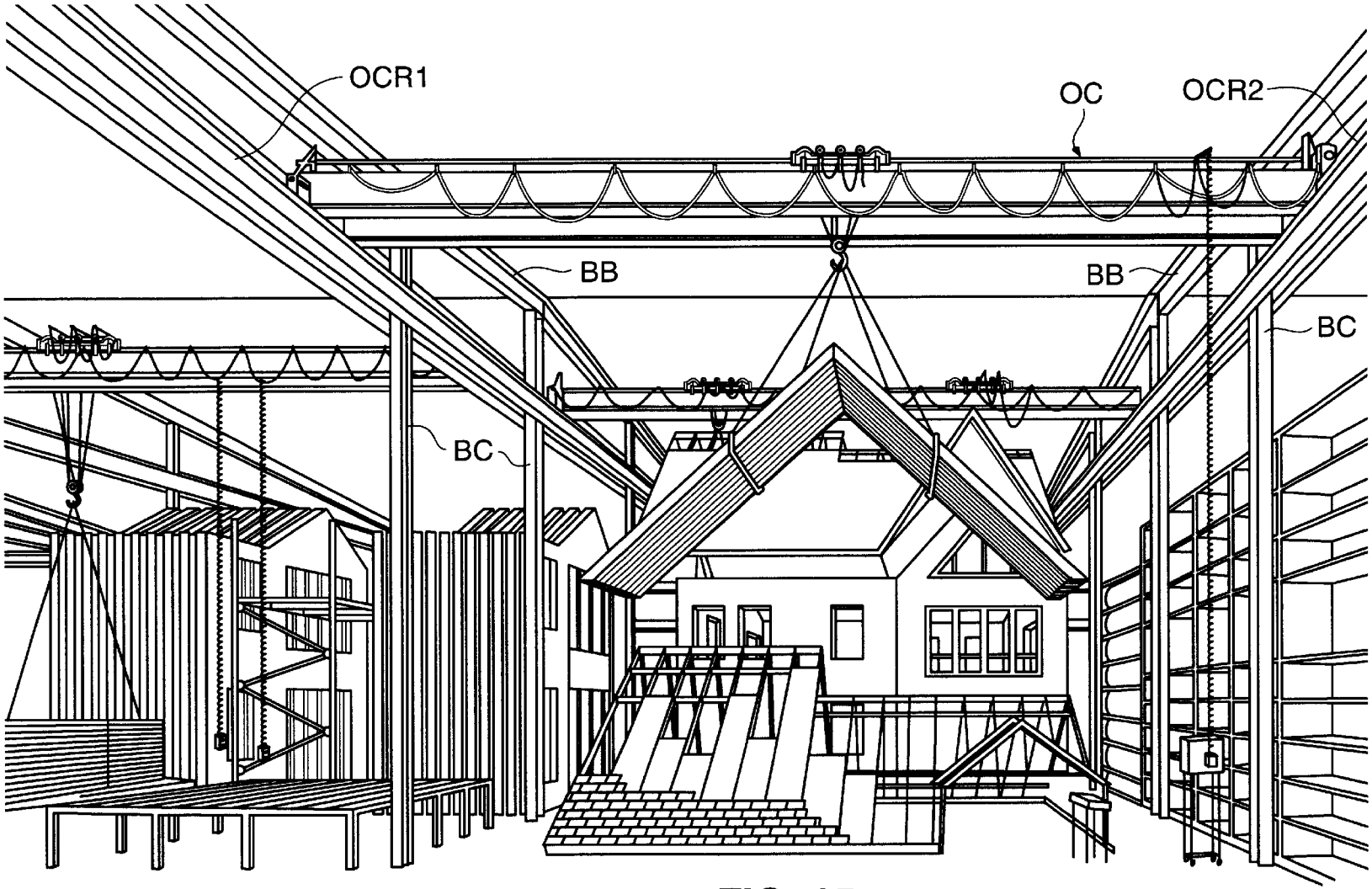
FIG. 15 illustrates a perspective view of a typical bent and hoisting element details.

FIG. 15 illustrates in perspective view the implementation of a typical hoisting element that is used in a production line of the movable manufacturing facility 100. The hoisting element can be any of a number of such devices known for the purpose, such as but not limited to: boom type cranes, gantry cranes, hydraulic cranes, and travelling floor cranes mounted on wheels or rails. For the preferred embodiment of the first production line P1 of the movable manufacturing facility 100 disclosed herein the hoisting element is shown to be an overhead travelling crane OC. The rails OCR1, OCR2 on which the overhead crane OC ride are directly connected to the columns BC which support the two bents BB that delimit the boundaries of a production line (for example, fourth production line P4) of the movable manufacturing facility 100 and extend substantially the full length of the two bents BB, so that the crane OC can traverse the entirety of the production line P4 as well as either or both of the two adjoining alleys, delivery alley DA, dwelling assembly alley HA.

Another one of the many possible embodiments of the enclosure is the use of a fabric type of enclosure which fabric is stretched over a framework to enclose the work area. In this application, there is not a need for bents and the hoisting elements can be free standing elements or connected to the columns.

First Production Line

Figure 4:
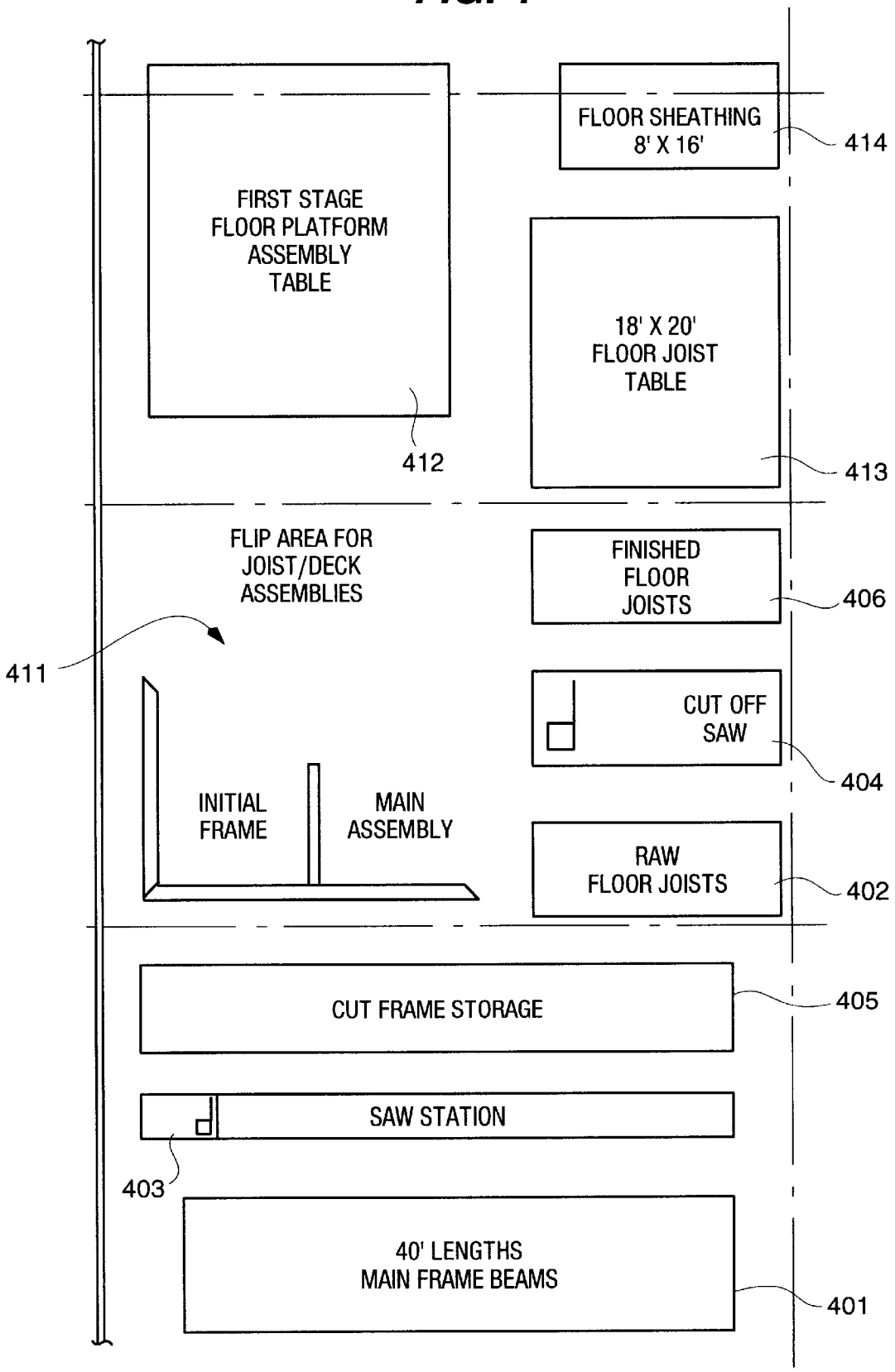
FIGS. 4–8 illustrate typical implementations of the various production lines contained in a typical embodiment of the movable manufacturing facility which comprises a plurality of parallel oriented juxtaposed production lines bounded by orthogonal alleys.
Figure 9:
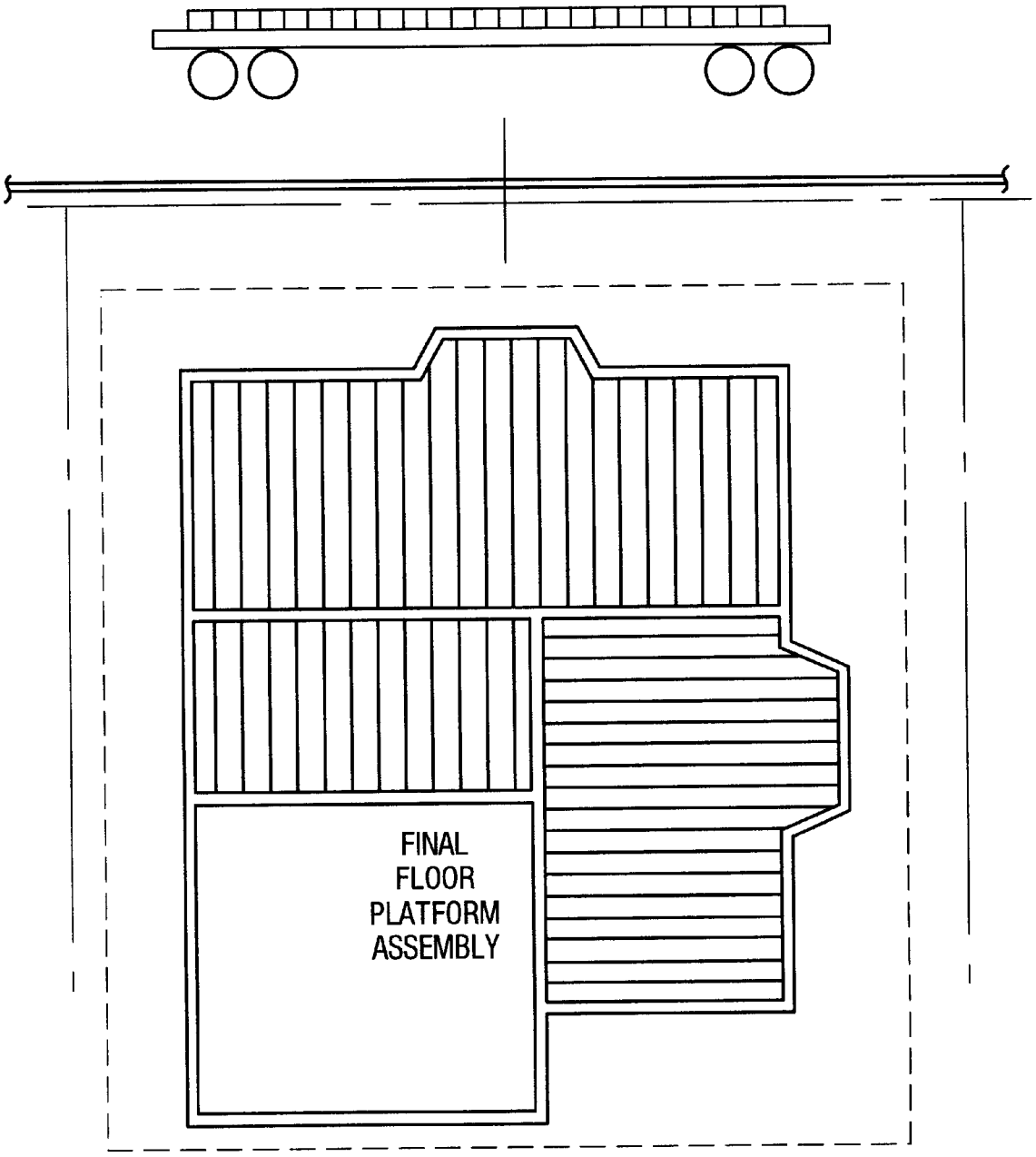
FIGS. 9–13 illustrate plan and side views of the portion of a typical standard size dwelling produced at each of the production lines of the movable manufacturing facility illustrated in FIGS. 4–8.

FIG. 4 illustrates a typical plan view of the first production line of the movable manufacturing facility 100, while FIG. 9 illustrates both a plan view and a side view of a typical segment of the standard size dwelling D that is assembled in the dwelling assembly alley HA as a result of the work performed in the first production line P1 of the movable manufacturing facility 100. The first production line P1 of the movable manufacturing facility 100 is primarily used to create the floor subassembly, which as a minimum includes the residential integral base frame, and can also include the floor joist assembly and subflooring. The floor platform subassemblies are then typically placed on to the transport element T that is positioned in the dwelling assembly alley HA juxtaposed to one end of the first production line P1 of the movable manufacturing facility 100.

The equipment and work areas of the first production line P1 comprise a number of raw material processing stages. In particular, standard lengths of the integral base frame beams and floor joists are delivered by truck or rail to the delivery alley DA and the hoisting element HI of the first production line P1 moves these raw materials from the delivery vehicle to storage bins or racks 401, 402 located within the first production line P1. For example, 40 foot lengths of integral base frame beams are noted in FIG. 4, although other lengths as required can be used. Associated with each storage area 401, 402 is a saw station 403, 404 that is used to cut where necessary the raw material into the required lengths. The cut stock is then stockpiled in finished material storage racks 405, 406. For example, the cut beams are stored in cut frame storage 405 while the cut floor joists are placed into the finished floor joist storage 406. Preferably, the amount of cutting is kept to a minimum by the pre-architected layout of the first floor subflooring and integral base frame.

An integral base frame assembly production line 411 is included in the first production line P1 and is described in additional detail below. The partially assembled integral base frames are transported from the integral base frame assembly production line 411 by the overhead crane Hi and placed on the first stage floor platform assembly 412 table. The floor joist table 413 is used to create a subassembly of floor joists, with insulation, wiring, plumbing installed therein and the overlay of floor sheathing, obtained from the floor sheathing storage rack 414, installed thereon. The overhead crane Hi transports floor joist subassemblies from the floor joist table 413 to the first stage floor platform assembly table 412 to be placed within the partially assembled frame. The frames, with floor joist subassemblies installed therein are then "capped" and transported by the overhead crane HI to the dwelling assembly alley HA where they are placed on the transport element T in a predetermined position and interconnected with other (if any) frames produced to create a complete floor subassembly.

Transport Element

Figure 14:
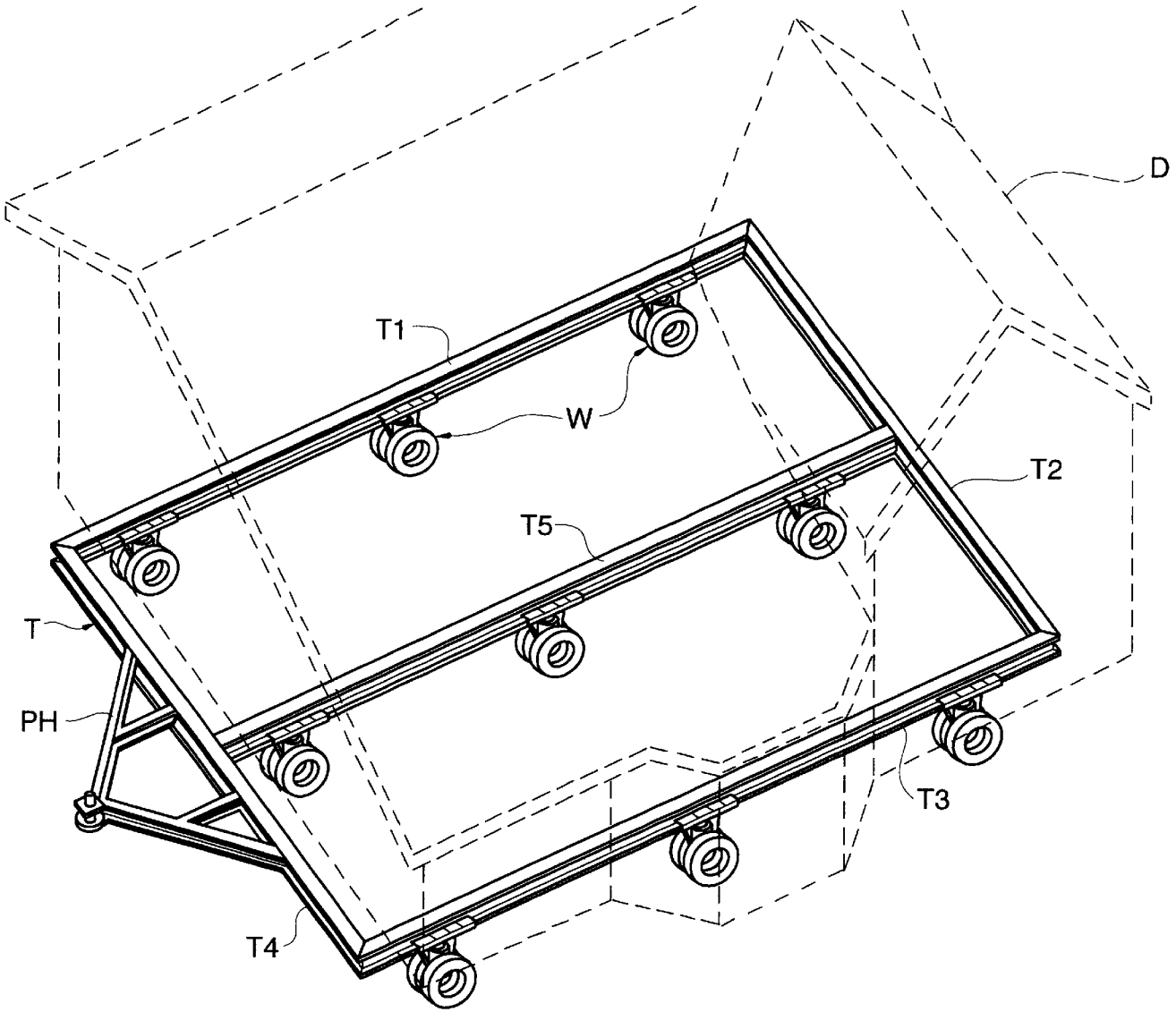
FIG. 14 illustrates a perspective view of the architecture of a typical transport element used in this manufacturing process and its actual use to transport a standard size dwelling.

FIG. 14 illustrates in perspective view a typical transport element T that is used to support the standard size dwelling D (as shown in FIG. 14) as it is assembled in the movable manufacturing facility 100 and transported from this facility to a permanent site. The transport element T, as shown in a typical embodiment in FIG. 14, comprises a rectangular frame formed of a plurality of rigid interconnected supporting members T1–T5. A number of the supporting members T1–T4 form the substantially rectangular exterior frame and the remaining supporting member T5 forms an interior supporting member. A standard size dwelling is shown in dotted line outline form placed on the transport element T to illustrate the size and extent of the transport element T with respect to a standard size dwelling. The typical supporting members T1–T5 are shown as steel I-beams of sufficient capacity to support the full size dwelling. Three of the supporting members T1, T3, T5 are shown equipped with wheel assemblies W to thereby enable the transport element T to be repositioned within the movable manufacturing facility 100 and thence to the building site for the standard size dwelling placed on the transport element. FIG. 14 also illustrates a towing hitch PH affixed to one end of the substantially rectangular frame formed of supporting members T1–T5 to thereby enable a tow vehicle to connect to the transport element T and perform the transportation function.

It is obvious that a number of alternative embodiments of the transport element T can be devised, such as having axles span the entire width of the transport element, as a function of the performance characteristics required for the specific implementation of the movable manufacturing facility 100 as well as the nature of the path that the transport element may take to the building site. It is also envisioned that the wheel assemblies W can be made removable from the frame formed of supporting members T1–T5. Thus, it is possible that the transport element can comprise the integral base frame FF of the structure itself, with the wheel assemblies W initially installed thereto to facilitate the movement of the standard size dwelling through the manufacturing process and delivery to the building site. Once installed at the building site, the standard size dwelling no longer requires the wheel assemblies W, and these can be removed for reuse in the manufacturing of another standard size dwelling. Also, the wheel assemblies W can be interchanged so that a separate set is used to move the standard size dwelling D to the building site. The wheel assemblies W may also be dispensed with in the factory if the foundation frame is used as part of a rail system.

Integral Base Frame Architecture

The integral base frame is that structural element which is integral to the base of a movable manufacturing facility produced standard size home, and provides the non-removable structural foundation upon which the vertical framing elements for the dwelling are attached. The integral base frame allows a standard size home to be created in its entirety and moved prior to being located on a permanent foundation. The integral base frame is typically provided at the base of the outside bearing perimeter walls, at interior load bearing walls, at selected other locations and may be contained within a floor subassembly.

The function of the integral base frame can be seen when an existing home is moved from one location to another. In this situation, the existing home is gently lifted off its permanent foundation, usually by means of jacks. At this point, a base frame is temporarily inserted under the perimeter and load bearing interior walls to support them thereby permitting the entire structure to be carefully moved on to two support beams without the benefit of a permanent foundation. In the movable manufacturing facility, the standard size home is built with an integral base frame to enable the simple relocation of the partially built home within the movable manufacturing facility and eventually to a permanent foundation at the home site. The home can also be later moved without significant complexity, since the structure incorporates the integral base frame and can be relocated to another permanent foundation.

Thus, the standard size home built in the movable manufacturing facility is substantially built "in space" rather than "in place". For this to be possible, the initial step in the manufacturing process requires the use of the integral base frame which establishes a solid point of beginning and provides a dimensionally stable foundation. The integral base frame thereby provides structural integrity to the base of the movable manufacturing facility manufactured home, which enables the home to exist in space without continuous additional support to enable the standard size home to be manufactured, transported and placed on a permanent foundation as an integral, self-supporting and rigidized structure. The integral base frame distributes vertical loads downward from the wall sections to the transport element and upward from the transport element to the load bearing walls. The integral base frame also provides a dimensionally stable flat surface on which the wall elements can be added and can be manufactured from light gauge steel, wood, concrete, plastic, or other suitable materials.

Integral Base Frame Assembly

Figure 16:
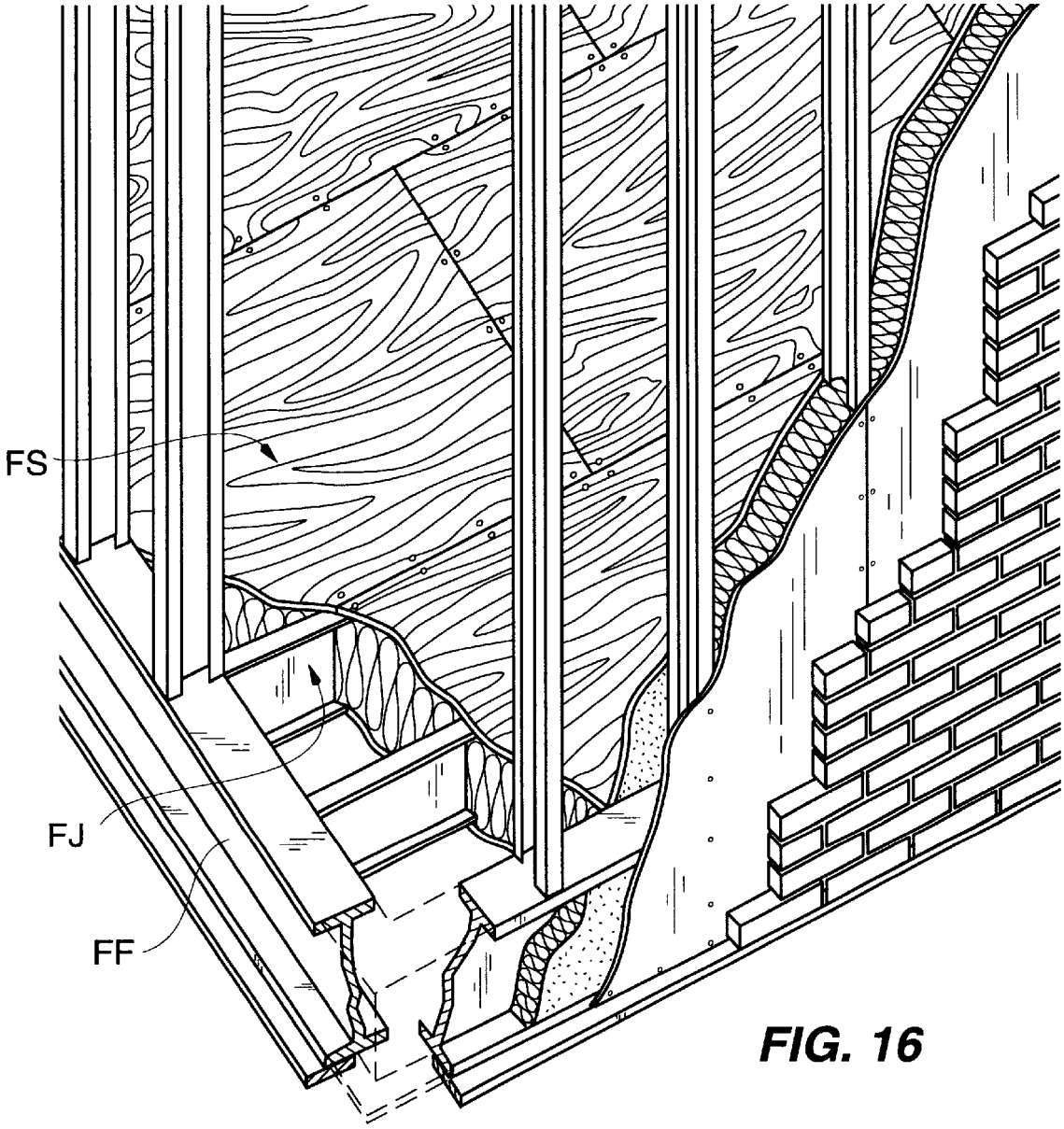
FIG. 16 illustrates a perspective view of a typical integral base frame used in the manufacturing process.

FIG. 16 illustrates in perspective view a typical architecture of the integral base frame assembly FF that is used in the standard size dwelling manufacturing process. In particular, the integral base frame FF is the element that circumscribes the entirety of the standard size dwelling D and provides the support and stability to enable the entire completed structure to be relocated by a crane C from a transport element T to the preassembled foundation at the building lot B. In order to accomplish this function, the integral base frame FF comprises a set of steel beams, such as I-beams, that are assembled into a framework that conforms to the foundation. The I-beams, as shown in FIG. 16, are assembled by welding together to form a framework into which a floor joist assembly FJ can be fabricated. This process is effected by the overhead crane H1 transporting the partially assembled integral base frame FF from the frame assembly area 411 to the first stage floor platform assembly table 412. The overhead crane H1 then lifts a completed floor joist subassembly, from the floor joist table 413 and relocates the subassembly to the first stage floor platform assembly table 412 where it is inserted into the partially assembled integral base frame FF. Additional precut I-beams are then transported by the overhead crane H1 from the storage racks 405 to the first stage floor platform assembly table 412 where they are positioned to cap the open ends of the partially assembled integral base frame FF and complete an entire section of the floor subassembly. The joists FJ are secured to the integral base frame FF via welds at points where one of the steel joists FJ meet a corresponding point of the integral base frame FF. The dimensions of the integral base frame FF and the joists FJ are preferably selected so that the joists snugly fit within the "pocket" created by the cross-section of the integral base frame elements and the capped integral base frame FF creates a resultant dimensionally stable and rigid floor subassembly. The floor sheathing FS, as shown in FIG. 16, is placed to expose a length of the joists FJ sufficient to fit within the pocket provided by the integral base frame FF, so the assembled floor subassembly does not include any voids between the floor sheathing FS and the integral base frame FF. The floor sheathing FS can be of dimensions greater than typically used since the hoisting element H1 can be used to transport these materials.

Second Production Line

Figure 5:
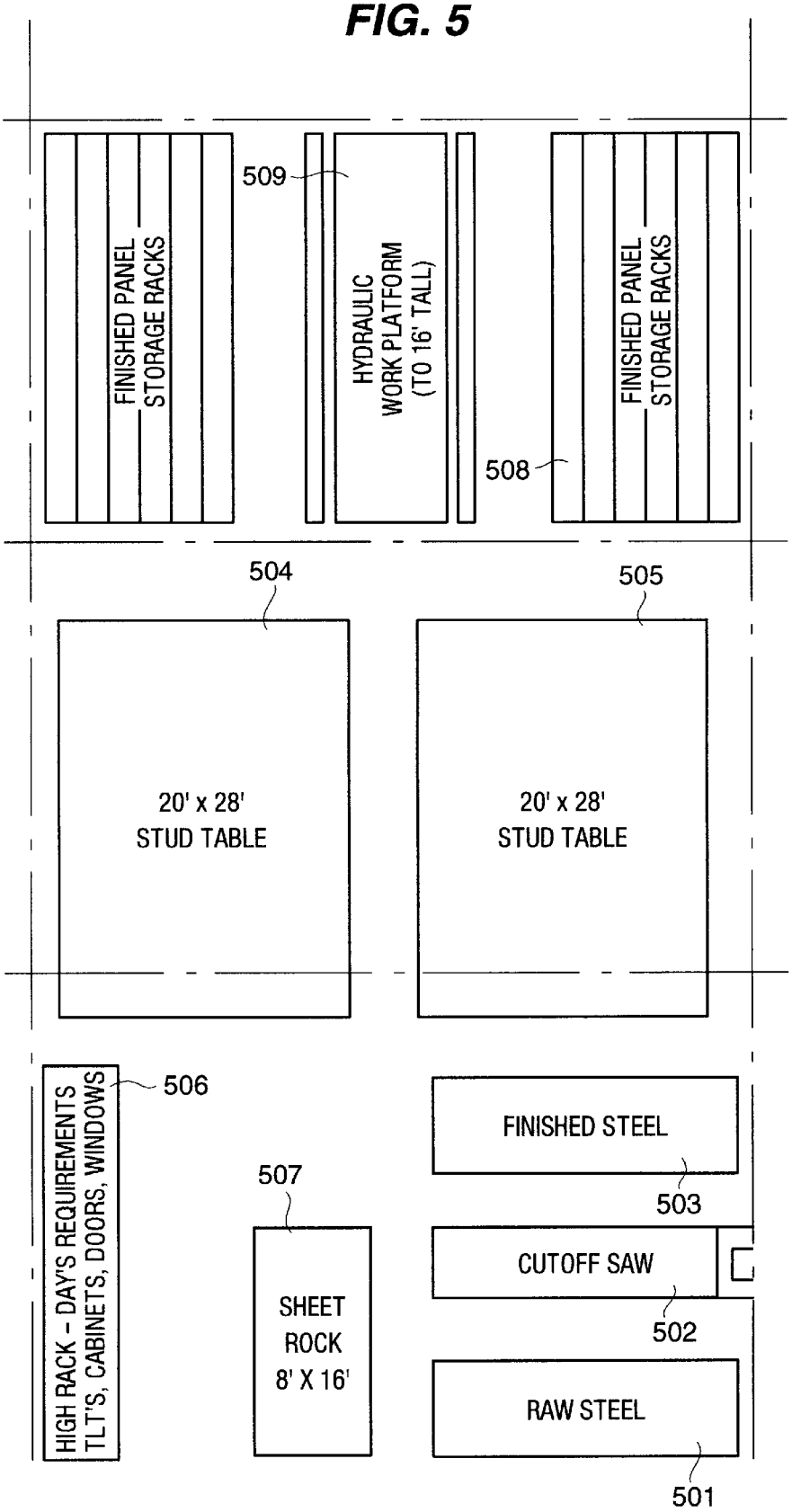
Figure 10:
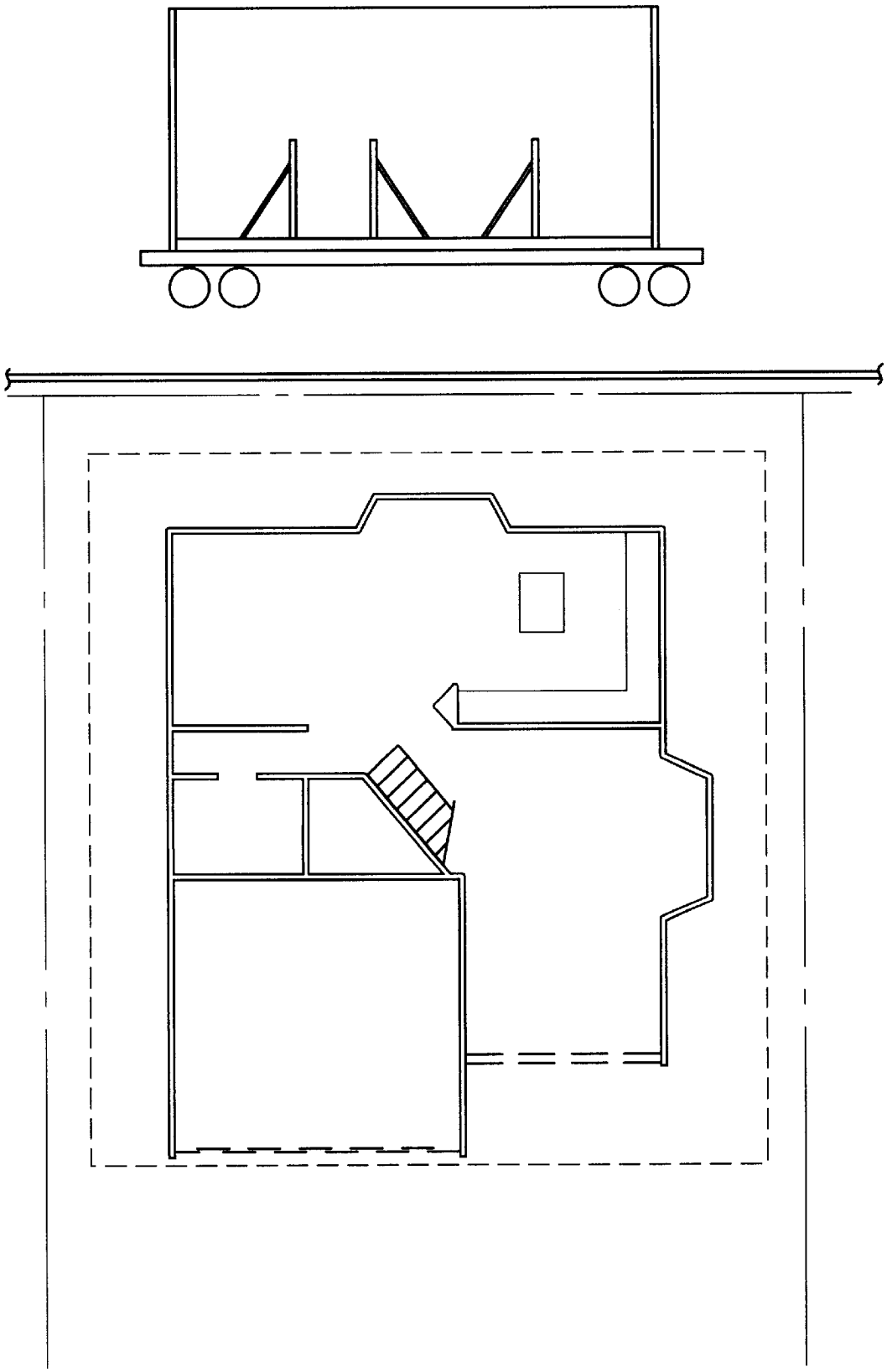

FIG. 5 illustrates a typical plan view of the second production line P2 of the movable manufacturing facility 100, while FIG. 10 illustrates both a plan view and a side view of a typical segment of the standard size dwelling D that is assembled in the dwelling assembly alley HA as a result of the work performed in the second production line P2 of the movable manufacturing facility 100. The second production line P2 of the movable manufacturing facility 100 is primarily used to fabricate the exterior walls and first floor interior walls of the standard size dwelling D.

The equipment and work areas of the second production line P2 comprise at least one raw material processing stage. The raw materials used to perform the framing function can be selected from the class of elements including, but not limited to: wood, steel, composition materials. For the purpose of illustrating the operation of the preferred embodiment of the movable manufacturing facility 100, steel is described as the element used for framing the interior and exterior walls. In particular, standard lengths of raw steel framing members are delivered by truck or rail to the delivery alley DA and the hoisting element H2 (or multiple hoisting elements) of the second production line P2 moves these raw materials from the delivery vehicle to storage bins or racks 501, 506, 507 located within the second production line P2. For example, 20 foot lengths of framing members can be used, although other lengths as required can be used. Associated with each storage area 501 is a saw station 502 that is used to cut where necessary the raw material into the required lengths. The cut stock is then stockpiled in finished material storage racks 503. Preferably, the amount of cutting is kept to a minimum by the pre-architected layout of the exterior walls and first floor interior walls.

A wall panel assembly production line is included in the second production line P2. At least one stud table 504, 505 is provided to create a subassembly of an exterior or interior wall, with insulation, wiring, plumbing, windows, doors installed therein as desired. The overhead crane H2 transports wall panel assemblies from the stud table 504, 505 to the work platform 509 where movable scaffolding is used to enable the workers to finish the wall subassemblies. The movable scaffolding enables the workers to move with respect to the wall subassembly and tape drywall seams, finish the drywall, and paint the wall subassembly. The finished wall subassembly is then relocated to the storage racks 508 of the second production line P2 (as also shown in perspective view on the left side of FIG. 15) or directly placed in position and secured in the dwelling D being assembled in the dwelling assembly alley HA, as also shown in part in FIG. 16. If the premanufactured panels are first stored in the storage racks 508, the premanufactured panels are later transported by the overhead crane H2 to the dwelling assembly alley HA where they are placed on the floor subassembly, which was installed on the transport element T at the first production line P1 of the movable manufacturing facility 100, in a predetermined position and interconnected with other wall subassemblies to create a complete framed and subfloored structure assembly.

The exterior finish may not be present on the exterior walls to thereby enable the workers to access the various utilities that are run through the walls. As wall segments are joined, the utilities pre-installed therein must be interconnected, and this can be done via access from the exterior (or top) of the wall, rather than the interior as is presently done. The multitude of subsystems that comprise a dwelling are treated as an integrated system with the progression of construction of each subsystem coordinated with the various other systems to ensure coherent construction of the dwelling in an efficient manner.

At this juncture, to increase the speed of manufacture, reduce the handling of materials, cabinet assemblies, doors, windows, floor coverings etc. (from rack 506) are prestocked in the shell of the standard size dwelling D. The prestocking enables the workers at later stages of assembly to have the necessary materials already situated within the standard size dwelling D, via crane H*, to enable the workers to perform finish work concurrently with the second story and the roof being assembled and installed on the standard size dwelling D. The materials, such as drywall, can be of dimensions greater than typically used since the hoisting element H2 can be used to transport these materials, rather than depending on the workers to handle each piece individually, with the size of the materials being dictated by the physical limitations of the workers.

Third Production Line P3

Figure 6:
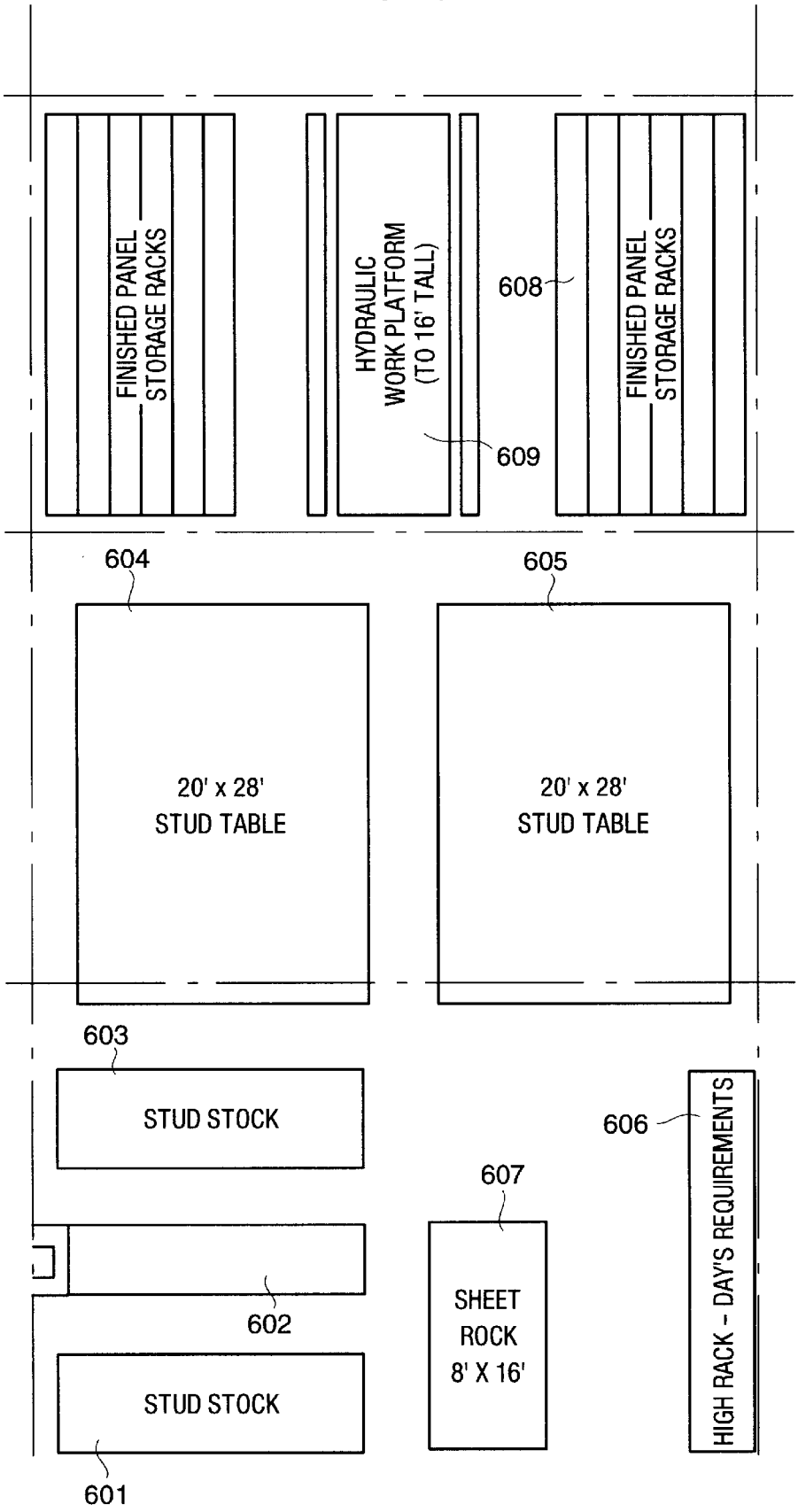
Figure 11:
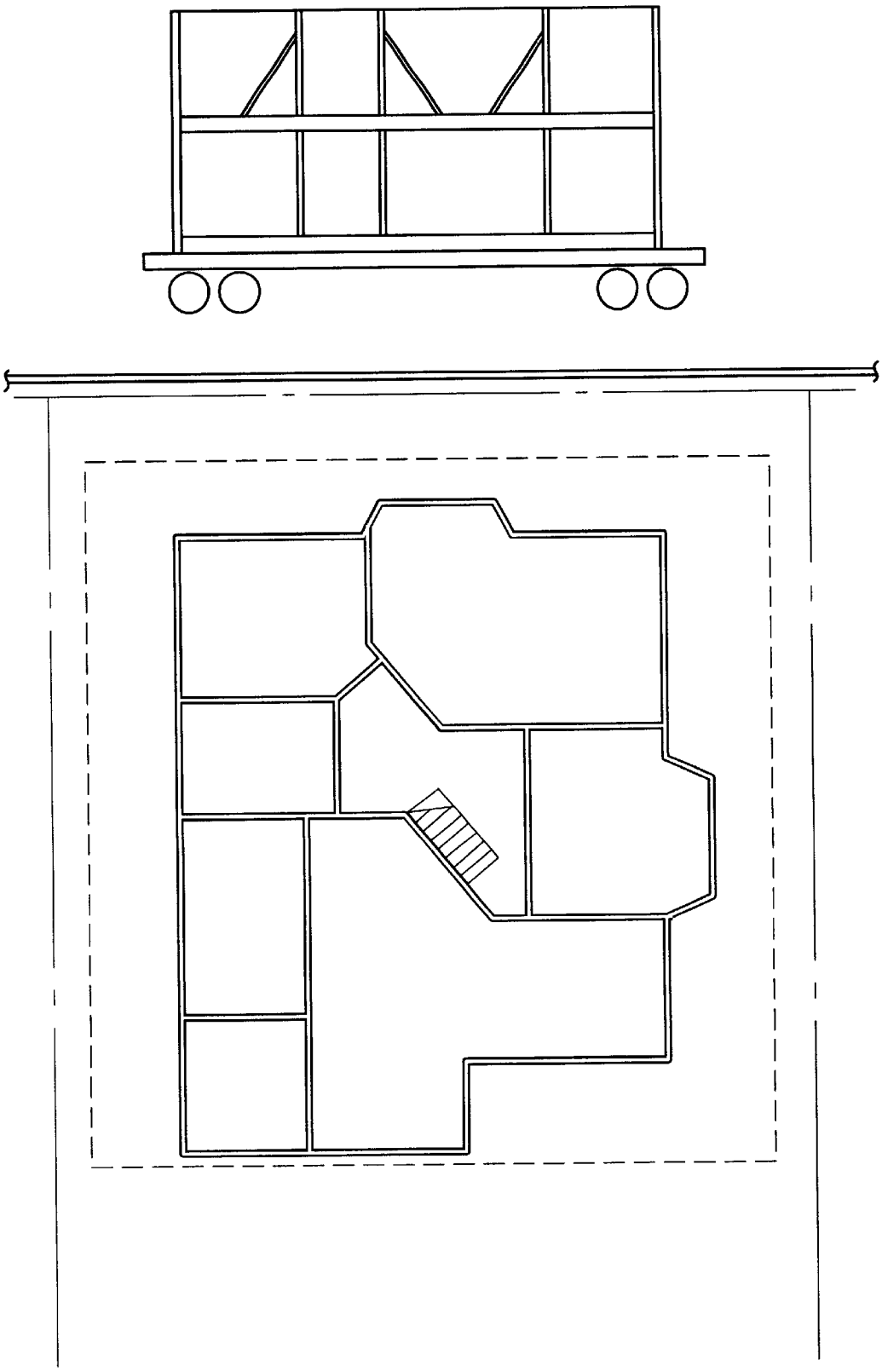

FIG. 6 illustrates a plan view of a typical third production line P3 of the movable manufacturing facility 100, while FIG. 11 illustrates both a plan view and a side view of a typical segment of the standard size dwelling D that is assembled in the dwelling assembly alley HA as a result of the work performed in the third production line P3 of the movable manufacturing facility 100. The third production line P3 is predicated on the presumption that the standard size dwelling being manufactured is a two story dwelling. Obviously, if one story dwellings are being manufactured, the third production line P3 as described herein may be deemed to be unnecessary.

The equipment and work areas of the third production line P3 are similar to those of the second production line P2 and comprise at least one raw material processing stage. In particular, standard lengths of raw steel framing members are delivered by truck or rail to the delivery alley DA and the hoisting element H3 of the third production line P3 moves these raw materials from the delivery vehicle to storage bins or racks 601, 606, 607 located within the third production line P3. For example, 20 foot lengths of framing members can be used, although other lengths as required can be used. Associated with each storage area is a saw station 602 that is used to cut where necessary the raw material into the required lengths. The cut stock is then stockpiled in finished material storage racks 603. Preferably, the amount of cutting is kept to a minimum by the pre-architected layout of the exterior walls and second floor interior walls.

A floor and wall panel assembly production line is included in the third production line P3. At least one stud table 604, 605 is provided to create a subassembly of the first floor ceiling/second story floor, exterior or interior walls, with insulation, wiring, plumbing installed therein. The overhead crane H3 transports floor and wall panel assemblies from the stud table 604, 605 to the work platform 609 where movable scaffolding is used to enable the workers to finish the wall subassemblies. The movable scaffolding enables the workers to move with respect to the wall subassembly and tape drywall seams, finish the drywall, and paint the wall subassembly. The finished wall subassembly is then relocated to the storage racks 608 of the third production line P3 (as shown in perspective view on the left of FIG. 15) or directly placed in position in the dwelling being assembled in the dwelling assembly alley HA. If the premanufactured wall panels are first stored in the storage racks 608, the premanufactured wall panels are then transported by the overhead crane H3 to the dwelling assembly alley HA where they are placed on the preassembled first floor, which was installed on the transport element T at the second production line P2 of the movable manufacturing facility 100, in a predetermined position and interconnected with the exterior and first story interior wall panels to create a completely enclosed framed and subfloored single story structure assembly.

The second floor premanufactured wall panels are then transported by the overhead crane H3 to the dwelling assembly alley HA where they are placed on the framed single story structure to complete the framing of the second story. At this juncture, to reduce the labor required, cabinet assemblies, doors, windows, etc. (in rack 606) are "prestocked in the second story of the shell of the standard size dwelling D. The prestocking enables the workers at later stages of assembly to have the necessary materials already situated within the standard size dwelling D, via crane H3, to enable the workers to perform finish work concurrently with the roof being assembled and installed on the standard size dwelling D. The materials, such as drywall, can be of dimensions greater than typically used since the hoisting element H3 can be used to transport these materials, rather than depending on the workers to handle each piece individually, with the size of the materials being dictated by the physical limitations of the workers.

Fourth Production Line P4

Figure 7:
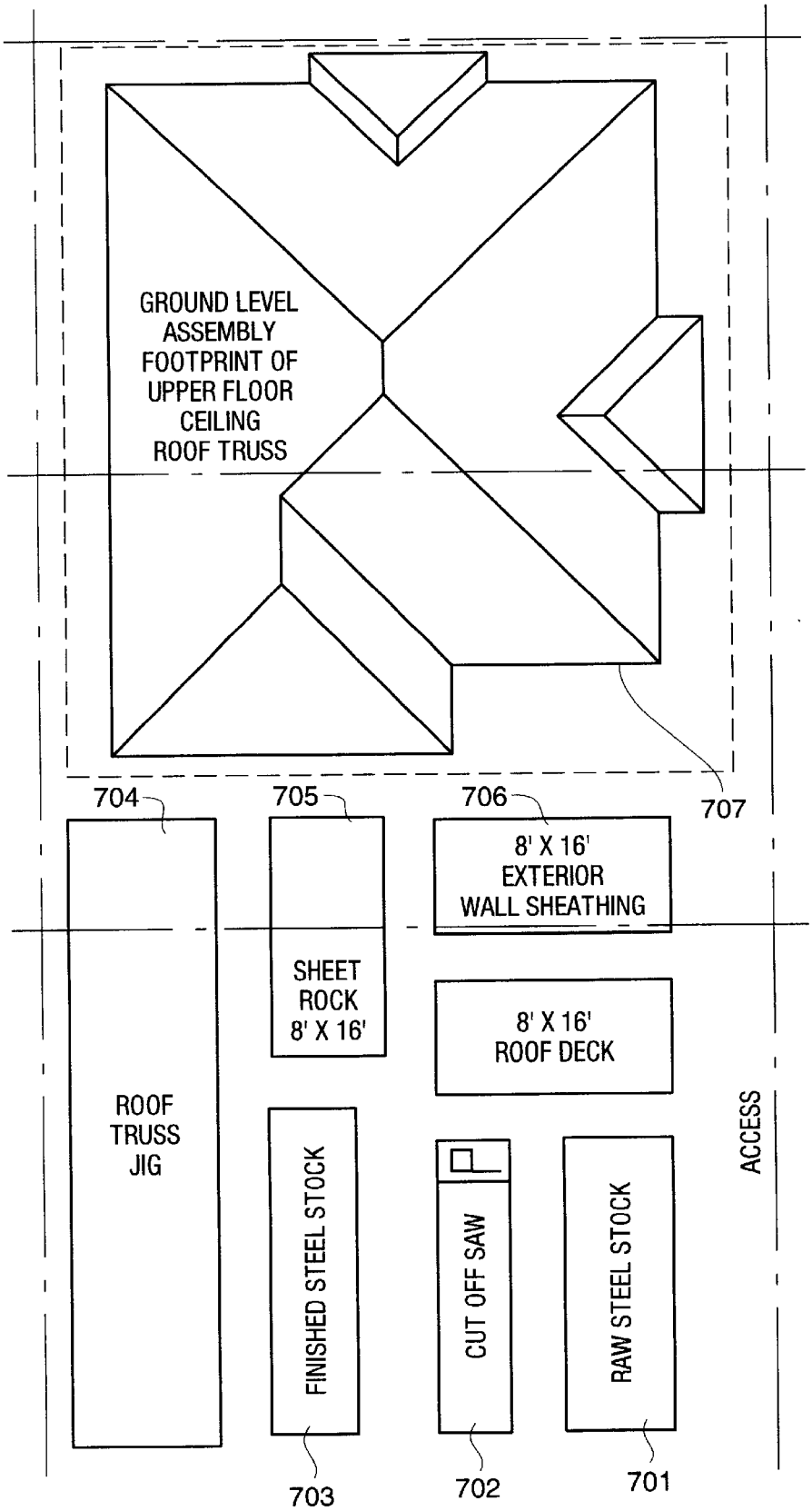
Figure 12:
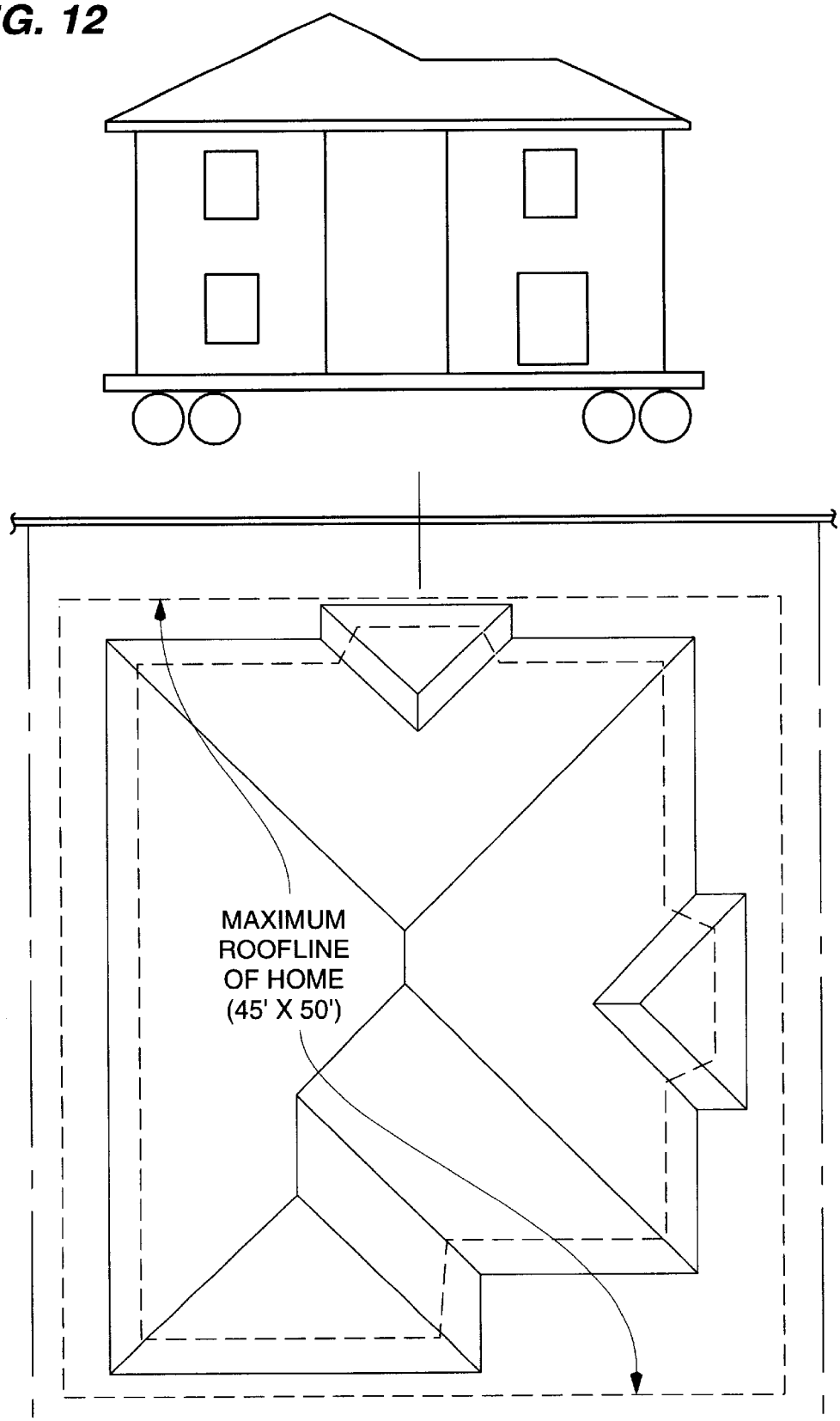

FIG. 7 illustrates a plan view of a typical fourth production line P4 of the movable manufacturing facility 100, while FIG. 12 illustrates both a plan view and a side view of the segment of the standard size dwelling D that is assembled in the dwelling assembly alley HA as a result of the work performed in the fourth production line P4 of the movable manufacturing facility 100. In addition, FIG. 15 illustrates an end view of a typical fourth production line P4. The fourth production line P4 of the movable manufacturing facility 100 is primarily used to fabricate, relocate and install the roof subassembly of the standard size dwelling D.

The equipment and work areas of the fourth production line P4 comprise at least one raw material processing stage. In particular, standard lengths of raw steel framing members and roof truss members are delivered by truck or rail to the delivery alley DA and the hoisting element H4 of the fourth production line P4 moves these raw materials from the delivery vehicle to storage bins or racks 701 located within the fourth production line P4. For example, 20 foot lengths of framing members can be used, although other lengths as required can be used. Associated with each storage area is a saw station 702 that is used to cut where necessary the raw material into the required lengths. The cut stock is then stockpiled in finished material storage racks 703. Preferably, the amount of cutting is kept to a minimum by the prearchitected layout of the roof.

A roof subassembly production line is included in the fourth production line P4. A roof truss jig 704 is provided to enable the workers to produce the required roof trusses which are then moved by hoisting element H4 to the roof subassembly fabrication areas 707 to create an entire roof subassembly. The drywall materials are retrieved from drywall storage area 705 and positioned in the pattern that is required for the finished area of the ceiling that lies under the roof. The drywall is then adhesively secured to the roof trusses when these elements are positioned on the drywall that is in place on the roof subassembly fabrication areas 707. The roof construction then proceeds with the required roof sheathing, etc until the entire roof subassembly is completed. The roof subassembly is then hoisted into place on top of the framed shell of the two story structure and thus must be constructed somewhat differently from existing roof designs. In particular, since the crane H4 "picks and places" the entire roof subassembly, the trusses used to fabricate the roof subassembly must be designed to support both dynamic and static traditional roof loads, supported by the frame of the house, as well as to be capable of supporting the weight of the assembled roof when supported from the ridge line as it is being hoisted. Therefore, the roof trusses must be designed to account for compression and tension loads in both directions. The overhead crane H4 (termed OC in FIG. 15) transports the completed roof subassembly from the roof subassembly fabrication areas 707 to the dwelling assembly alley HA where it is placed on the framed structure, which was installed on the transport element T at the first P1 through third P3 production lines of the movable manufacturing facility 100, in a predetermined position and interconnected with the interior and exterior wall production lines to create a complete enclosed standard size dwelling D.

The fabrication of the roof subassembly on the roof subassembly fabrication areas 707 results in a reduced assembly time, since working on ground level is easier, safer and more efficient than constructing the roof in place on the framed two story dwelling as is presently done in the stick building technology.

Fifth Production Line P5

Figure 8:
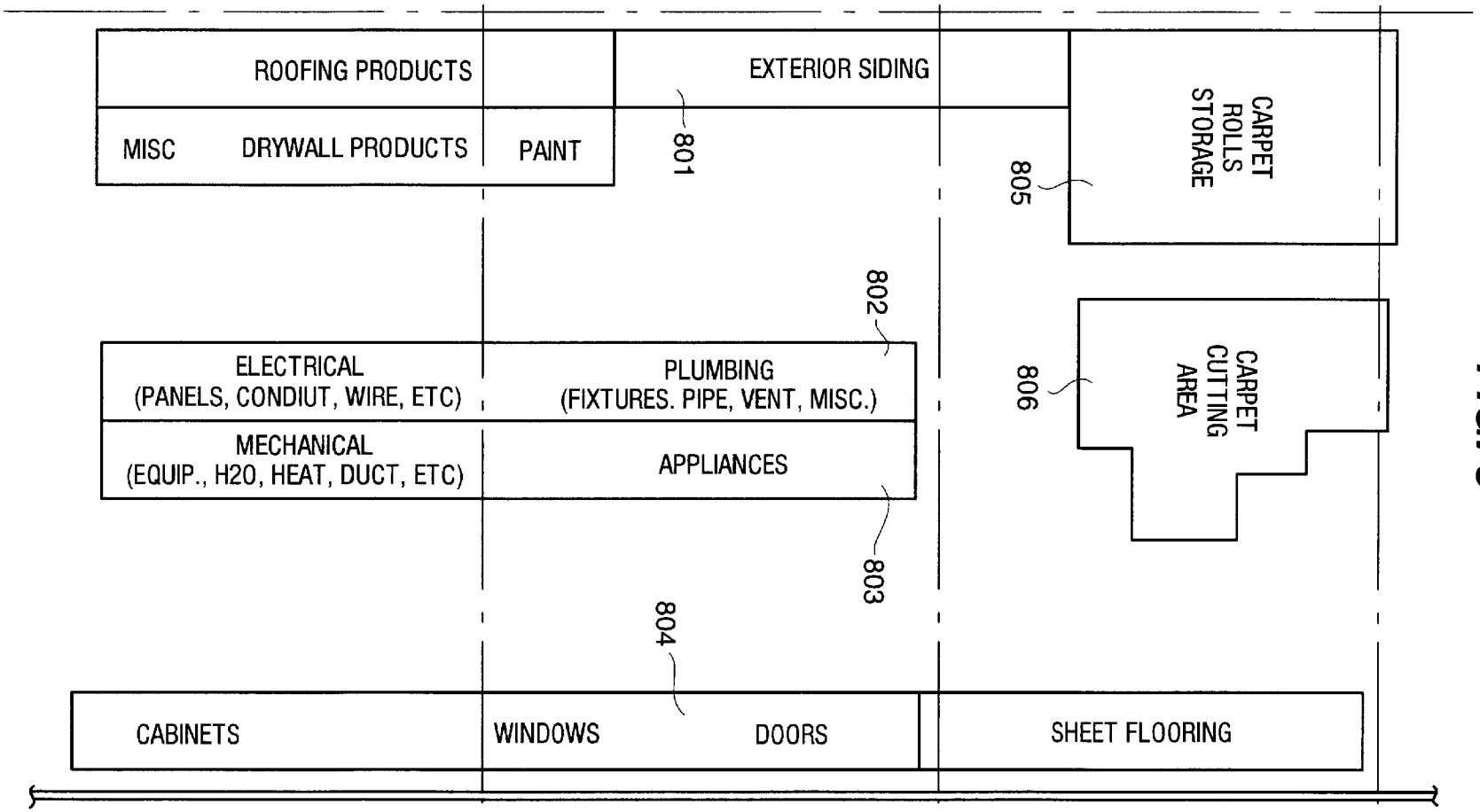
Figure 13:
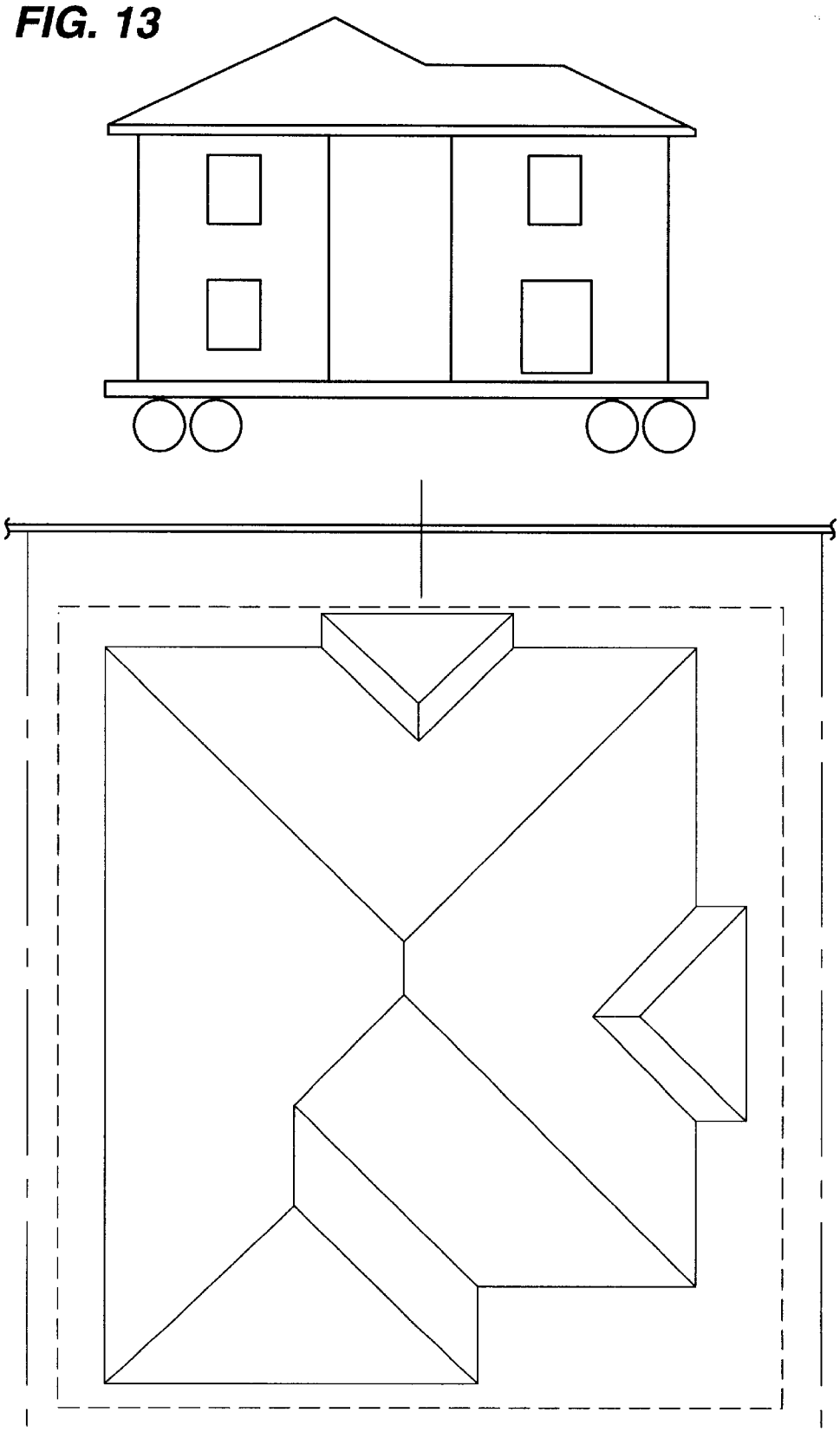

FIG. 8 illustrates a plan view of a typical fifth production line P5 of the movable manufacturing facility 100, while FIG. 13 illustrates both a plan view and a side view of a typical segment of the standard size dwelling D that is assembled in the dwelling assembly alley HA as a result of the work performed in the fifth production line P5 of the movable manufacturing facility 100. In particular, the fifth production line P5 of the movable manufacturing facility 100 is used to perform all remaining finish work that was not completed in the previous manufacturing stages. In this regard, the fifth production line P5 may not strictly be termed a production line since no subassembly is produced therein, but instead, in the preferred embodiment of the movable manufacturing facility 100, it is used as a storage and staging area where the prestocking materials, such as floor covering, are stored and cut to size for transportation to the appropriate production line for insertion into the partially competed dwelling located in the dwelling assembly alley HA, as described above. Therefore, the finish work includes any remaining painting, installation of plumbing fixtures, electrical outlets, trim work, appliance installation, etc. Additional exterior work that was not previously completed is now done, such as gutters, roofing, flashing, exterior trim painting, etc. The materials for these activities can be stored in a plurality of rows of high bay storage racks 801–804 as shown in perspective view on the right hand side of FIG. 15. The materials handled in the fifth production line P5 of the movable manufacturing facility 100 may be more adapted to processing using a forklift truck rather than an overhead crane H*. In addition, the delivery alley DA may include a number of external overhead doors in traditional loading dock style to enable the rapid unloading of many enclosed delivery vehicles, each of which may deliver a small quantity of materials, when compared to the deliveries processed at the other production lines P1–P4 of the movable manufacturing facility 100. Furthermore, the dwelling assembly alley HA may not be contiguous with the fifth production line P5, since there is not necessarily any relocation of large bundles of materials to the dwelling at this stage of production. Therefore, the dwelling can even be moved at this juncture to a section of the building remote from the production lines P1–P5, or "off-site" external to the building to another enclosed structure, or even in an open area outside.

Additional Features

It is evident that the delivery alley DA can include a storage area, located across the delivery alley DA from the production lines. The materials storage is a function of the proportion of just-in-time deliveries that can be scheduled for the movable manufacturing facility 100. It is evident that the storage areas must be sized as a function of the materials fragility, volume of construction activity, and delays expected in the delivery of raw materials. Thus, weather impervious materials, such as roofing material and structural steel can be stored external to the movable manufacturing facility and moved in place into the production lines by forklift or even a hoisting element that is integral to the delivery alley DA. Furthermore, the fifth production line P5 includes a flooring storage area in the above-described embodiment, and the flooring material is cut and then transported by forklift to the second and/or third production lines P2, P3 as required to preload the first and second floor of the partially completed dwelling prior to the respective ceilings being placed on the partially completed dwelling, thereby enclosing that particular volume of the dwelling. The use of the integral hoisting elements H* also enables the use of atypical size and weight materials. The sheet rock, roof sheathing, exterior wall sheathing and subflooring can be in 6'*16' or 8'*16' sizes, which are impossible for workers to handle by hand, but are well within the capability of the hoisting elements. The use of this size materials minimizes the number of seams in the wall, ceiling and floor subassemblies, thereby reducing finishing labor and providing additional rigidity to the resultant dwelling.

Figure 17:
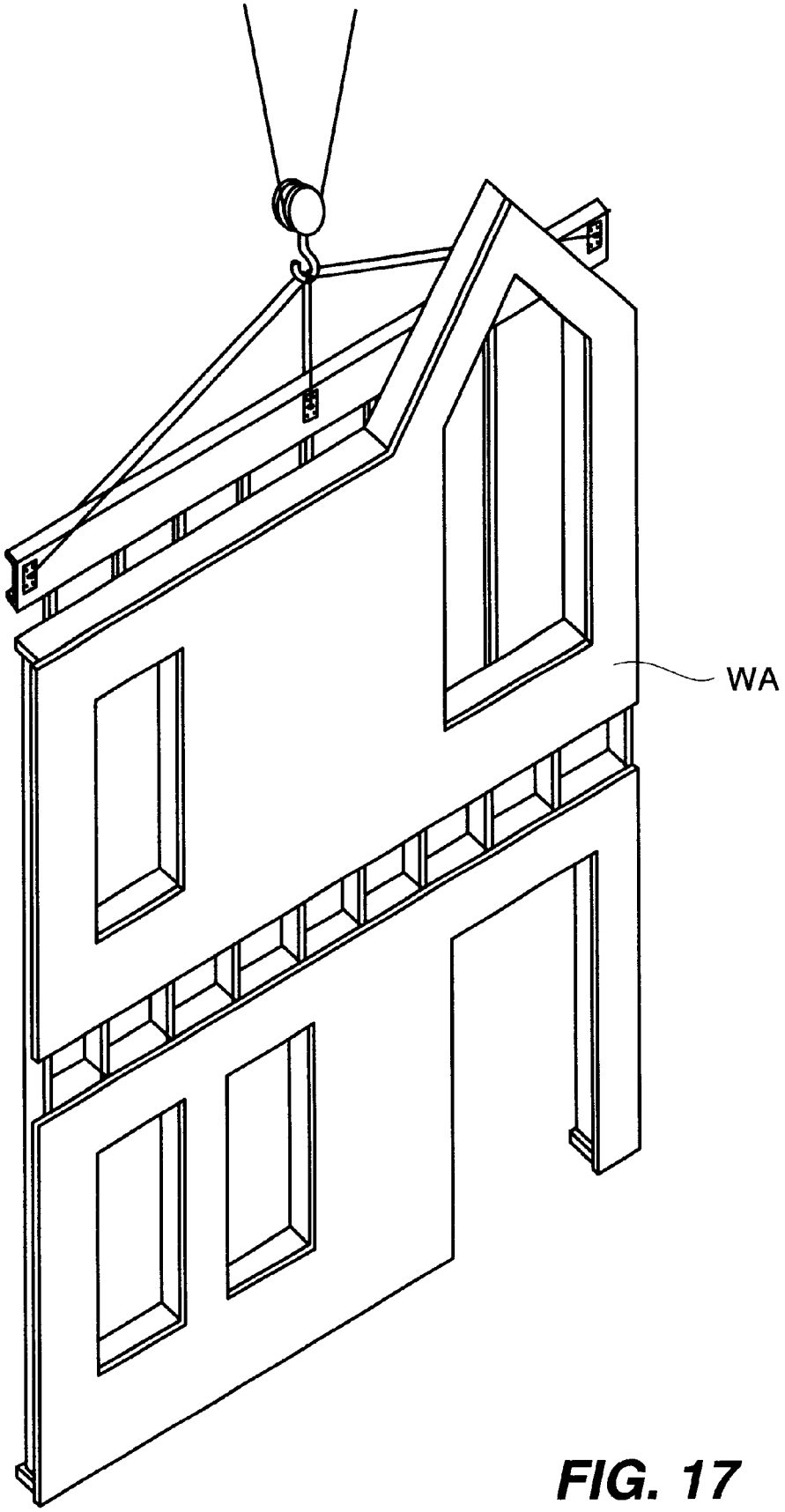
FIG. 17 illustrates in perspective view a typical multistory panel implemented using steel framing members.

Furthermore, two-story wall subassemblies can be manufactured using the steel framing materials described herein. FIG. 17 illustrates a perspective view of a typical two-story wall panel subassembly that can be manufactured using the facilities described herein. In particular, the two-story wall panel subassembly is constructed to be placed on and secured to the floor subassembly, and is preconfigured to receive the joists for the second floor flooring. As shown in this figure, the entire two-story subassembly can be hoisted and transported as an integral unit.

Summary

The benefits of the movable manufacturing facility 100 are that there is concurrent and/or overlapping construction of major subassemblies of the standard size dwelling D in the various production lines P1–P5 of the movable manufacturing facility 100. The completed subassemblies from production lines P1–P4 are then assembled in the dwelling assembly alley HA in assembly line fashion as the standard size dwelling D reaches that production line P* of the movable manufacturing facility 100. For example, the second floor walls can be manufactured in the third production line P3 of the movable manufacturing facility 100 while the floor subassembly and first floor walls are being built and assembled in the first and second production lines P1, P2 of the movable manufacturing facility 100. The second story ceiling can be manufactured in the fourth production line P4 of the movable manufacturing facility 100. In addition, the roof can be concurrently under way or initiated in the fourth production line P4 of the movable manufacturing facility 100 while the standard size dwelling D is located at the third production line P3 of the movable manufacturing facility 100 for installation of the second story floor and walls. The temporal coordination of the various stages of work can be dynamically adjusted as a function of material availability as well as construction progress at previous and subsequent production lines of the movable manufacturing facility 100. The shear panels can be manufactured and stockpiled at the second P2 and third P3 production lines of the movable manufacturing facility 100, and the workers can move between production lines P* as the changing needs of the assembly process dictate. In addition, there are no delays occasioned by ambient weather conditions, and significantly reduced waste due to the "automated" method of manufacturing.

The standard size dwellings produced in this movable manufacturing facility represent significant advances from what is produced by the housing industry today. It is achieved by collapsing the traditional sequential building process into a small finite number of steps, each of which is implemented in a predetermined production line of the facility somewhat independent of, yet in close coordination with, the building activity that takes place in the other production lines of the facility. This allows, for instance, a house's roof and floor to be assembled at the same time, yet on different production lines. Once individual components are pre-assembled, they are affixed, either directly or indirectly, to the rigidized integral base frame as it advances through the dwelling assembly alley. This final assembly of the housing components occurs in a very short period of time. Quality is assured by virtue of a controlled work environment within the movable manufacturing facility, factory tolerances, a streamlined, repetitive labor task assembly process, etc. The sequential, mutually exclusive and disjunct subcontractor operations of the prior art are replaced with a partitioning of the construction process to functionally complete the construction of predetermined volumetric sections of the structure at each of the production lines as the dwelling progresses through the movable manufacturing facility. Thus, wall sheathing and finishing may be started earlier than in the traditional stick-built building process while some operations, such as electrical and plumbing, can be done from the exterior of the dwelling when interior walls are in place. Each dwelling exits the movable manufacturing facility as a substantially completed "turn key" standard size dwelling ready for occupancy. These examples are indicative of a streamlined and efficiency driven approach to dwelling construction, which makes use of a factory environment to revolutionize the dwelling construction process for standard size homes.

We claim:

1. A manufacturing facility for constructing standard size dwellings substantially in their entirety, said manufacturing facility being located proximate a location at which standard size dwellings are to be sited said manufacturing facility comprising:

a plurality of subassembly production lines, at least two of said subassembly production lines being used for constructing predetermined subassemblies for said standard size dwelling, each of said predetermined subassemblies comprising a structural section of said standard size dwelling, from the class of structural sections consisting of: walls, floors, roof, foundation base frame;

a dwelling assembly alley for assembling a partially assembled standard size dwelling therein;

hoisting means operational in each of said at least two subassembly production lines for transporting said constructed predetermined subassemblies to said dwelling assembly alley for incorporation into a partially assembled standard size dwelling being assembled therein; and wherein said standard size dwelling is assembled substantially in its entirety in said dwelling assembly alley using said predetermined subassemblies, which are incorporated into said partially assembled standard size dwelling.

2. The manufacturing facility of claim 1 wherein said hoisting means comprises an overhead crane that traverses a one of said at least two subassembly production lines and a section of said dwelling assembly alley adjacent said one of said at least two said subassembly production lines.

3. The manufacturing facility of claim 1 further comprising:

at least one transport element movable through said dwelling assembly alley for supporting and moving said partially assembled standard size dwelling.

4. The manufacturing facility of claim 2 wherein said enclosed structure has a wall, said dwelling assembly alley includes a doorway located in said wall of said enclosed structure and sized to enable transport elements, which are used to carry said standard size dwelling constructed within said enclosed structure, to exit said enclosed structure transporting a substantially completed standard size dwelling via said doorway.

5. The manufacturing facility of claim 4 wherein said enclosed structure has a second wall, said dwelling assembly alley includes a second doorway located in said second wall of said enclosed structure to enable said transport elements, which are used to carry said standard size dwelling constructed within said enclosed structure, to enter said enclosed structure via said second doorway.

6. The manufacturing facility of claim 1 wherein said plurality of subassembly production lines are oriented substantially parallel to and juxtaposed to at least one other subassembly production line and orthogonal to said dwelling assembly alley, said plurality of subassembly production lines comprise:

a first of said subassembly production lines for constructing a floor subassembly comprising an integral base frame for placement on a transport element, which is located in said dwelling assembly alley; and a second of said subassembly production lines, located adjacent said first subassembly production line, for constructing a plurality of panelized wall assemblies for assembly on to said floor subassembly located on said transport element which is located in said assembly alley to produce a partially assembled standard size dwelling.

7. The manufacturing facility of claim 6 wherein said plurality of subassembly production lines further comprises:

a third of said subassembly production lines, located adjacent said second subassembly production line, for constructing second story wall assemblies for assembly on to said partially assembled standard size dwelling located on said transport element, which is located in said dwelling assembly alley; and a fourth of said subassembly production lines, located adjacent said third subassembly production line, for constructing a roof subassembly for assembly on to said partially assembled standard size dwelling which is located on said transport element located in said dwelling assembly alley.

8. The manufacturing facility of claim 6 wherein said plurality of subassembly production lines further comprises:

a roofing subassembly production line, for constructing a roof subassembly for assembly on to said partially assembled standard size dwelling located on said transport element which is located in said dwelling assembly alley.

9. The manufacturing facility of claim 1 further comprising:

a substantially enclosed structure of interior height sufficient to assemble a standard size dwelling therein.

10. The manufacturing facility of claim 9 wherein said dwelling assembly alley is of interior height sufficient to assemble a standard size dwelling therein.

11. The manufacturing facility of claim 9 wherein said enclosed structure comprises:

a plurality of bents, each supported by a plurality of support columns, a plurality of said bents and associated plurality of support columns being oriented between adjacent subassembly production lines.

12. The manufacturing facility of claim 11 wherein said hoisting element comprises an overhead crane which operates on a set of rails, which rails are supported by said associated plurality of support columns oriented between adjacent subassembly production lines.

13. The manufacturing facility of claim 1 further comprising:

a delivery alley located substantially proximate to said at least two subassembly production lines for receiving deliveries of materials used in construction of said standard size dwelling.

14. The manufacturing facility of claim 13 wherein said delivery alley includes a material storage area.

15. The manufacturing facility of claim 13 wherein said manufacturing facility further comprises a substantially enclosed structure, said delivery alley includes a first doorway located in a wall of said enclosed structure to enable delivery vehicles to enter said enclosed structure via said first doorway.

16. The manufacturing facility of claim 15 wherein said delivery alley includes a second doorway located in a second wall of said enclosed structure to enable delivery vehicles to exit said enclosed structure via said second doorway.

17. The manufacturing facility of claim 13 wherein said hoisting means in each of said at least two subassembly production lines comprises at least one movable crane that traverses said subassembly production line and a section of said dwelling assembly alley adjacent said subassembly production line.

18. The manufacturing facility of claim 17 wherein said movable crane in each of said at least two subassembly production lines also traverses a section of said delivery alley adjacent said subassembly production line.

19. The manufacturing facility of claim 1 wherein a first of said subassembly production lines is used to construct a floor subassembly comprising an integral base frame for placement on a transport element, which is located in said dwelling assembly alley and juxtaposed said first subassembly production line, which transport element transports said partially assembled standard size dwelling through said dwelling assembly alley.

20. The manufacturing facility of claim 19 wherein a second of said subassembly production lines is used to construct a plurality of panelized exterior wall assemblies and interior walls for assembly on to said floor subassembly located on said transport element, which is located in said dwelling assembly alley and juxtaposed to said second subassembly production line, to produce a partially assembled standard size dwelling.

21. The manufacturing facility of claim 20 wherein a third of said subassembly production lines is used to construct a second story wall assemblies for assembly on to said partially assembled standard size dwelling located on said transport element, which is located in said dwelling assembly alley and juxtaposed said third subassembly production line.

22. The manufacturing facility of claim 19 wherein a second of said subassembly production lines is used to construct a plurality of panelized wall assemblies for assembly on to said floor subassembly located on said transport element, which is located in said dwelling assembly alley and juxtaposed said second subassembly production line, to create a partially assembled standard size dwelling.

23. The manufacturing facility of claim 22 wherein a third of said subassembly production lines is used to construct second story wall subassemblies, for installation in the partially assembled standard size dwelling located on said transport element, which is located in said dwelling assembly alley and juxtaposed said third subassembly production line.

24. The manufacturing facility of claim 23 wherein a fourth of said subassembly production lines is used to construct a roof subassembly for assembly on to said partially assembled standard size dwelling located on said transport element, which is located in said dwelling assembly alley and juxtaposed said fourth subassembly production line.

25. The manufacturing facility of claim 24 wherein said hoisting means located in said third subassembly production line transports finish elements to be installed in a second floor of said partially assembled standard size dwelling prior to said transport element relocating said partially assembled standard size dwelling from a position in said dwelling assembly alley opposite said third subassembly production line to a position opposite said fourth subassembly production line.

26. The manufacturing facility of claim 23 wherein said hoisting means located in said second subassembly production line transports finish elements to be installed in a first floor of said partially assembled standard size dwelling prior to said transport element relocating said partially assembled standard size dwelling from a position in said dwelling assembly alley opposite said second subassembly production line to a position opposite said third subassembly production line.

27. A manufacturing facility for constructing standard size, non-roadable dwellings, having length and width dimensions, substantially in their entirety in said manufacturing facility, said manufacturing facility being located proximate a location at which standard size dwellings produced in said manufacturing facility are to be sited after exiting said manufacturing facility, and comprising:

a plurality of subassembly production lines, at least two of said plurality of subassembly production lines providing means for constructing predetermined subassemblies of said standard size dwelling, each of said predetermined subassemblies comprising a structural section of said standard size dwelling, from the class of structural sections consisting of: walls, floors, roof trusses, roof, foundation base frame;

a dwelling assembly alley located substantially proximate to said at least two subassembly production lines for providing a site for assembling a partially assembled standard size dwelling therein;

hoisting means operational in said at least two subassembly production lines for transporting said constructed predetermined subassemblies from said at least two subassembly production lines to said dwelling assembly alley to install said constructed predetermined subassemblies into a partially assembled standard size dwelling located therein, which partially assembled standard size dwelling is non-roadable by having at least one of the dimensional characteristics: the smaller of said length and width dimensions being greater than 16 feet and being greater than one story in height; and wherein said dwelling assembly alley provides a transport element for transporting said partially assembled standard size dwelling while said standard size dwelling is assembled from said predetermined subassemblies by respectively incorporating said predetermined subassemblies into said partially assembled standard size dwelling using said hoisting means when said partially assembled standard size dwelling is positioned in said assembly alley opposite a corresponding one of said plurality of subassembly production lines until said partially assembled standard size dwelling is assembled substantially in its entirety.

28. The manufacturing facility of claim 27 wherein a first of said subassembly production lines is used to construct a floor subassembly comprising an integral base frame for placement on said transport element, which is located in said dwelling assembly alley and juxtaposed said first subassembly production line, which transport element transports said partially assembled standard size dwelling through said dwelling assembly alley.

29. The manufacturing facility of claim 28 wherein a second of said subassembly production lines is used to construct a plurality of panelized wall assemblies for assembly on to said floor subassembly located on said transport element, which is located in said dwelling assembly alley and juxtaposed said second subassembly production lines to create a partially assembled standard size dwelling.

30. The manufacturing facility of claim 29 wherein a third of said subassembly production lines is used to construct second story wall subassemblies, for installation in the partially assembled standard size dwelling located on said transport element, which is located in said dwelling assembly alley and juxtaposed said third subassembly production line.

31. The manufacturing facility of claim 30 wherein a fourth of said subassembly production lines is used to construct a roof subassembly for assembly on to said partially assembled standard size dwelling located on said transport element, which is located in said dwelling assembly alley and juxtaposed said fourth subassembly production line.

32. The manufacturing facility of claim 31 wherein said hoisting means located in said third subassembly production line transports finish elements to be installed in a second floor of said partially assembled standard size dwelling prior to said transport element relocating said partially assembled standard size dwelling from a position in said dwelling assembly alley opposite said third subassembly production line to a position opposite said fourth subassembly production line.

33. The manufacturing facility of claim 30 wherein said hoisting means located in said second subassembly production line transports finish elements to be installed in a first floor of said partially assembled standard size dwelling prior to said transport element relocating said partially assembled standard size dwelling from a position in said dwelling assembly alley opposite said second subassembly production line to a position opposite said third subassembly production line.

34. The manufacturing facility of claim 28 wherein a second of said subassembly production lines is used to construct a plurality of panelized exterior wall assemblies and interior walls for assembly on to said floor subassembly located on said transport element, which is located in said dwelling assembly alley and juxtaposed to said second subassembly production line, to produce a partially assembled standard size dwelling.

35. The manufacturing facility of claim 34 wherein a third of said subassembly production lines is used to construct a second story wall assemblies for assembly on to said partially assembled full size dwelling located on said transport element, which is located in said dwelling assembly alley and juxtaposed said third subassembly production line.

36. The manufacturing facility of claim 27 wherein said plurality of subassembly production lines are oriented substantially parallel to and juxtaposed to at least one other subassembly production line and orthogonal to said dwelling assembly alley, said plurality of subassembly production lines comprise:

a first of said subassembly production lines for constructing a floor subassembly comprising an integral base frame for placement on said transport element, which is located in said dwelling assembly alley; and a second of said subassembly production lines, located adjacent said first subassembly production line, for constructing a plurality of panelized wall assemblies for assembly on to said floor subassembly located on said transport element, which is located in said assembly alley to produce a partially assembled standard size dwelling.

37. The manufacturing facility of claim 36 wherein said plurality of subassembly production lines further comprises:

a third of said subassembly production lines, located adjacent said second subassembly production line, for constructing a second story wall assemblies for assembly on to said partially assembled standard size dwelling located on said transport element, which is located in said dwelling assembly alley; and a fourth of said subassembly production lines, located adjacent said third subassembly production line, for constructing a roof subassembly for assembly on to said partially assembled standard size dwelling which is located on said transport element located in said dwelling assembly alley.

38. The manufacturing facility of claim 36 wherein said plurality of subassembly production lines further comprises:

a roofing subassembly production line, for constructing a roof subassembly for assembly on to said partially assembled standard size dwelling located on said transport element, which is located in said dwelling assembly alley.

39. A manufacturing facility for constructing standard size dwellings substantially in their entirety, said manufacturing facility being located proximate a location at which standard size dwellings are to be sited, comprising:

a foundation assembly production line for constructing an integral foundation base frame that supports load bearing walls of said standard size dwelling;

at least two subassembly production lines for constructing predetermined subassemblies for said standard size dwelling, each of said predetermined subassemblies comprising a structural section of said standard size dwelling, from the class of structural sections consisting of: walls, floors, roof;

a dwelling assembly alley located substantially proximate to said at least two subassembly production lines for assembling a partially assembled standard size dwelling therein using said predetermined subassemblies, which are incorporated into said partially assembled standard size dwelling until said partially assembled standard size dwelling is assembled substantially in its entirety; and hoisting means operational in each of said at least two subassembly production lines for transporting said constructed predetermined subassemblies to said dwelling assembly alley for incorporation into a partially assembled standard size dwelling being assembled therein, with said hoisting means transporting at least a subset of load bearing ones of said predetermined subassemblies for direct connection to said integral foundation base frame.

40. The manufacturing facility of claim 39 wherein said at least two subassembly production lines comprises:

a floor subassembly production line for assembly of floor subassemblies for incorporation directly into said integral foundation base frame.

41. The manufacturing facility of claim 39 wherein said at least two subassembly production lines comprises:

a load bearing wall subassembly production line for assembly of load bearing wall subassemblies for incorporation into said partially assembled standard size dwelling by structural attachment to said integral foundation base frame.

42. The manufacturing facility of claim 39 wherein said foundation assembly production line produces an integral foundation base frame that circumscribes said standard size dwelling to support exterior walls of said standard size dwelling.

43. The manufacturing facility of claim 39 wherein said integral foundation base frame has a top surface thereof, said at least two subassembly production lines comprises:

a floor subassembly production line for assembly of floor subassemblies for incorporation directly into said integral foundation base frame absent being placed directly on said top surface of said integral foundation base frame.

44. The manufacturing facility of claim 43 wherein said at least two subassembly production lines comprises:

a load bearing wall subassembly production line for assembly of load bearing wall subassemblies for incorporation into said partially assembled standard size dwelling by structural attachment to said top surface of said integral foundation base frame.

* * * * *

US006253504C1

(12) EX PARTE REEXAMINATION CERTIFICATE (7270th)

United States Patent
Cohen et al.

(10) Number: US 6,253,504 C1
(45) Certificate Issued: Dec. 29, 2009

(54) MANUFACTURING FACILITY FOR PRODUCTION OF STANDARD SIZE DWELLINGS

(75) Inventors: David Leslie Cohen, Englewood, CO (US); Roger Blair Cohen, Wheat Ridge, CO (US)

(73) Assignee: Blue River Ranch LLC, Aurora, CO (US)

Reexamination Request:
No. 90/010,087, Jan. 8, 2008

Reexamination Certificate for:

| | |
|---|---|
| Patent No.: | **6,253,504** |
| Issued: | **Jul. 3, 2001** |
| Appl. No.: | **08/970,231** |
| Filed: | **Nov. 14, 1997** |

Related U.S. Application Data

(63) Continuation of application No. 08/502,812, filed on Jul. 14, 1995, now abandoned.

(51) Int. Cl.
*E04H 5/02* (2006.01)

(52) U.S. Cl. ..... 52/143; 52/745.2
(58) Field of Classification Search ..... 52/143, 52/745.2
See application file for complete search history.

(56) References Cited

U.S. PATENT DOCUMENTS 3,820,216 A * 6/1974 Ven Der Lely et al. ..... 425/110
4,187,659 A * 2/1980 Blachura ..... 52/745.02
5,402,618 A * 4/1995 Biffis et al. ..... 52/745.02

OTHER PUBLICATIONS

Building Tomorrow; The Mobile/Manufactured Housing Industry by Arthur D. Bernhardt (1980).*

* cited by examiner

*Primary Examiner*—Matthew C. Graham

(57) ABSTRACT

The movable manufacturing facility brings standard size home building comprehensively within a controlled factory environment. The main structure of the movable manufacturing facility is sufficiently tall to allow assembly and movement of standard size homes within. Multiple independent production lines are established to each produce portions of the dwelling in the form of subassemblies. Finishes, cabinets, appliances, roofs, paint, etc. are installed in the partially completed dwellings prior to houses leaving the produciton floor. The movable manufacturing facility allows a standard size home under construction to be advanced via a transport element from one production line to the next until complete. The completed homes are subsequently transported on the transport element over a controlled access roadway to individual sites with pre-constructed foundations specifically designed to accept these standard size dwellings. The standard size house can be relocated from the transport element and placed directly onto the foundation. High capacity hoisting, such as clear span bridge cranes, are the key to material handling and transportation on the production lines in the movable manufacturing facility. A drive through alley large enough to accommodate semi-trucks with loaded trailers may be located within the main structure of the movable manufacturing facility.

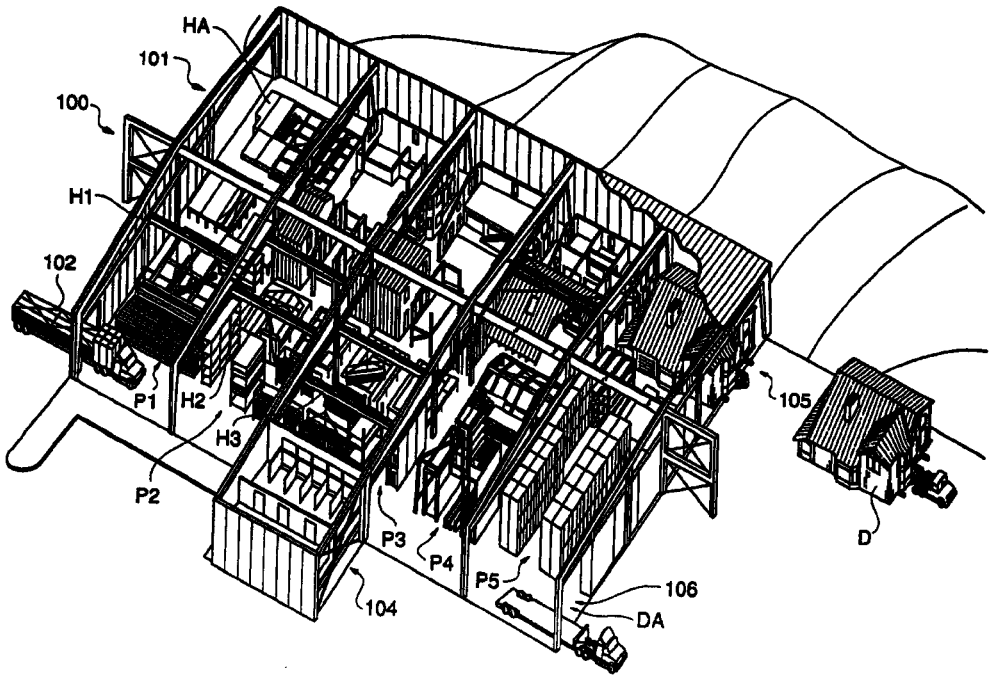

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6, 19, 20, 22, 27–29, 34, 36 and 41 are cancelled.

Claims 1, 7, 8, 21, 23, 24, 30, 31, 35, 37, 38 and 39 are determined to be patentable as amended.

Claims 2–5, 9–18, 25, 26, 32, 33, 40 and 42–44, dependent on an amended claim, are determined to be patentable.

1. A manufacturing facility for constructing standard size dewllings substantially in their entirety, said manufacturing facility being located proximate a location at which standard size dwellings are to be sited said manufacturing facility comprising:

a plurality of subassembly production lines, at least two of said subassembly production lines being used for constructing predetermined subassemblies for said standard size dwelling, each of said predetermined subassemblies comprising a structural section of said standard size dwelling, from the class of structural sections consisting of: walls, floors, roof, *and* foundation base frame*, comprising:*

*a first of said subassembly production lines for constructing a floor subassembly comprising an integral base frame for placement on a transport element, which is located in a dwelling assembly alley,*

*a second of said subassembly production lines, located adjacent said first subassembly production line, for constructing a plurality of panelized wall assemblies for assembly on to said floor subassembly located on said transport element which is located in said dwelling assembly alley to produce a partially assembled standard size dwelling,*

*a third of said subassembly production lines, located adjacent said second subassembly production line, for constructing second story wall assemblies for assembly on to said partially assembled standard size dwelling located on said transport element, which is located in said dwelling assembly alley*;

a dwelling assembly alley for assembling a partially assembled standard size dwelling therein;

hoisting means operational in each of said at least two subassembly production lines for transporting said constructed predetermined subassemblies to said dwelling assembly alley for incorporation into a partially assembled standard size dwelling being assembled therein; and wherein said standard size dwelling is assembled substantially in its entirety in said dwelling assembly alley using said predetermined subassemblies, which are incorporated into said partially assembled standard size dwelling.

7. The manufacturing facility of claim [6] *1* wherein said plurality of subassembly production lines further comprises:

[a third of said subassembly production lines, located adjacent said second subassembly production line, for constructing second story wall assemblies for assembly on to said partially assembled standard size dwelling located on said transport element, which is located in said dwelling assembly alley; and]

a fourth of said subassembly production lines, located adjacent said third subassembly production line, for constructing a roof subassembly for assembly on to said partially assembled standard size dwelling which is located on said transport element located in said dwelling assembly alley.

8. The manufacturing facility of claim [6] *1* wherein said plurality of subassembly production lines further comprises:

a roofing subassembly production line, for constructing a roof subassembly for assembly on to said partially assembled standard size dwelling located on said transport element which is located in said dwelling assembly alley.

21. [The manufacturing facility of claim 20] *A manufacturing facility for constructing standard size dwellings substantially in their entirety, said manufacturing facility being located proximate a location at which standard size dwellings are to be sited, said manufacturing facility comprising;*

*a plurality of subassembly production lines, at least two of said subassembly production lines being used for contructing predetermined subassemblies for said standard size dwelling, each of said predetermined subassemblies comprising a structural section of said standard size dwelling, from the class of structural sections consisting of: walls, floors, roof, and foundation base frame, comprising:*

*wherein a first of said subassembly production lines is used to construct a floor subassembly comprising an integral base frame for placement on a transport element, which is located in a dwelling assembly alley and juxtaposed to said first subassembly production line, which transport element transports said partially assembled standard size dwelling through said dwelling assembly alley,*

*wherein a second of said subassembly production lines is used to construct a plurality of panelized exterior wall assemblies and interior walls for assembly on to said floor subassembly located on said transport element, which is located in said dwelling assembly alley and juxtaposed to said second subassembly production line, to produce a partially assembled standard size dwelling*, wherein a third of said subassembly production lines is used to construct [a] second story wall assemblies for assembly on to said partially assembled standard size dwelling located on said transport element, which is located in said dwelling assembly alley and juxtaposed *to* said third subassembly production line*;*

*a dwelling assembly alley for assembling a partially assembled standard size dwelling therein;*

*hoisting means operational in each of said at least two subassembly production lines for transporting said constructed predetermined subassemblies to said dwelling assembly alley for incorporation into a partially assembled standard size dwelling being assembled therein; and*

*wherein said standard size dwelling is assembled substantially in its entirety in said dwelling assembly alley*

*using said predetermined subassemblies, which are incorporated into said partially assembled standard size dwelling.*

23. [The manufacturing facility of claim 22] *A manufacturing facility for constructing standard size dwellings substantially in their entirety, said manufacturing facility being located proximate a location at which standard size dwellings are to be sited, said manufacturing facility comprising:*

*a plurality of subassembly production lines, at least two of said subassembly production lines being used for constructing predetermined subassemblies for said standard size dwelling, each of said predetermined subassemlles comprising a structural section of said standard size dwelling, from the class of structural sections consisting of: walls, floors, roof, and foundation base frame, comprising:*

*wherein a first of said subassembly production lines is used to construct a floor subassembly coprising an integral base frame for placement on a transport element, which is located in a dwelling assembly alley and juxtaposed to said first subassembly production line, which transport element transports said partially assembled standard size dwelling through said dwelling assembly alley,*

*wherein a second of said subassembly production lines is used to construct a plurality of panelized wall assemblies for assembly on to said floor subassembly located on said transport element, which is located in said dwelling assembly alley and juxtaposed to said second subassembly production line, to create a partially assembled standard size dwelling,* wherein a third of said subassembly production lines is used to construct second story wall subassemblies, for installation in the partially assembled standard size dwelling located on said transport element, which is located in said dwelling assembly alley and juxtaposed to said third subassembly production line*;*

*a dwelling assembly alley for assembling a partially assembled standard size dwelling therein;*

*hoisting means operational in each of said at least two subassembly production lines for transporting said constructed predetermined subassemblies to said dwelling assembly alley for incorporation into a partially assembled standard size dwelling being assembled therein; and*

*wherein said standard size dwelling is assembled substantially in its entirety in said dwelling assembly alley using said predetermined subassemblies, which are incorporated into said partially assembled standard size dwelling.*

24. The manufacturing facility of claim 23 wherein a fourth of said subassembly production lines is used to construct a roof subassembly for assembly on to said partially assembled standard size dwelling located on said transport element, which is located in said dwelling assembly alley and juxtaposed *to* said fourth subassembly production line.

30. [The manufacturing facility of claim 29] *A manufacturing facility for constructing standard size, non-roadable dwellings, having length and width dimensions, substantially in their entirety in said manufacturing facility, said manufacturing facility being located proximate a location at which standard size dwellings produced in said manufacturing facility are to be sited after exiting said manufacturing facility, and comprising:*

*a plurality of subassembly production lines, at least two of said plurality of subassembly production lines providing means for constructing predetermined subassemblies of said standard size dwelling, each of said predetermined subassemblies comprising a structural section of said standard size dwelling, from the class of structural sections consisting of: walls, floors, roof trusses, roof, and foundation base frame, comprising:*

*wherein a first of said subassembly production lines is used to construct a floor subassembly comprising an integral base frame for placement on said transport element, which is located in a dwelling assembly alley and juxtaposed to said first subassembly production line, which transport element transports said partially assembled standard size dwelling through said dwelling assembly alley,*

*wherein a second of said subassembly production lines is used to construct a plurality of panelized wall assemblies for assembly on to said floor subassembly located on said transport element, which is located in said dwelling assembly alley and juxtaposed to said second subassembly production line to create a partially assembled standard size dwelling,* wherein a third of said subassembly production lines is used to construct second story wall subassemblies, for installation in the partially assembled standard size dwelling located on said transport element, which is located in said dwelling assembly alley and juxtaposed *to* said third subassembly production line*;*

*a dwelling assembly alley located substantially proximate to said at least two subassembly production lines for providing a site for assembling a partially assembled standard size dwelling therein;*

*hoisting means operational in said at least two subassembly production lines for transporting said constructed predetermined subassemblies from said at least two subassembly production lines to said dwelling asssembly alley to install said constructed predetermined subassemblies into a partially assembled standard size dwelling located therein, which partially assembled standard size dwelling is non-roadable by having at least one of the dimensional characteristics: the smaller of said length and width dimensions being greater than 16 feet and being greater than one story in height; and*

*wherein said dwelling assembly alley provides a transport element for transporting said partially assembled standard size dwelling while said standard size dwelling is assembled from said predetermined subassemblies by respectively incorporating said predetermined subassemblies into said partially assembled standard size dwelling using said hoisting means when said partially assembled standard size dwelling is positioned in said assembly alley opposite a corresponding one of said plurality of subassembly production lines until said partially assembled standard size dwelling is assembled substantially in is entirety.*

31. The manufacturing facility of claim 30 wherein a fourth of said subassembly production lines is used to construct a roof subassembly for assembly on to said partially assembled standard size dwelling located on said transport element, which is located in said dwelling assembly alley and juxtaposed *to* said fourth subassembly production line.

35. [The manufacturing facility of claim 34] *A manufacturing facility for constructing standard size, non-roadable dwellings, having length and width dimensions, substantially in their entirety in said manufacturing facility, said manufacturing facility being located proximate a location at*

*which standard size dwellings produced in said manufacturing facility are to be sited after exiting said manufacturing facility, and comprising:*

*a plurality of subassembly production lines, at least two of said plurality of subassembly production lines providing means for constructing predetermined subassemblies of said standard size dwelling, each of said predetermined subassemblies comprising a structural section of said standard size dwelling, from the class of structural sections consisiting of: walls, floors, roof trusses, roof, and foundation base frame, comprising:*

*wherein a first a said subassembly production lines is used to construct a floor subassembly comprising an integral base frame for placement on said transport element, which is located in a dwelling assembly alley and juxtaposed to said first subassembly production line, which transport element transports said partially assembled standard size dwelling through said dwelling assembly alley,*

*wherein a second of said subassembly production lines is used to construct a plurality of panelized exterior wall assemblies and interior walls for assembly on to said floor subassembly located on said transport element, which is located in said dwelling assembly alley and juxtaposed to said second subassembly production line, to produce a partially assembled standard size dwelling,* wherein a third of said subassembly production lines is used to construct [a] second story wall assemblies for assembly on to said partially assembled full size dwelling located on said transport element, which is located in said dwelling assembly alley and juxtaposed *to* said third subassembly production line*;*

*a dwelling assembly alley located substantially proximate to said at least two subassembly production lines for providing a site for assembling a partially assembled standard size dwelling therein;*

*hoisting means operational in said at least two subassembly production lines for transporting said constructed predetermined subassemblies from said at least two subassembly production lines to said dwelling assembly alley to install said constructed predetermined subassemblies into a partially assembled standard size dwelling located therein, which partially assembled standard size dwelling is non-roadable by having at least one of the dimensional characteristics: the smaller of said length and width dimensions being greater than 16 feet and being greater than one story in height; and*

*wherein said dwelling assembly alley provides a transport element for transporting said partially assembled standard size dwelling while said standard size dwelling is assembled from said predetermined subassemblies by respectively incorporating said predetermined subassemblies into said partially assembled standard size dwelling using said hoisting means when said partially assembled standard size dwelling is positioned in said assembly alley opposite a corresponding one of said plurality of subassembly production lines until said partially assembled standard size dwelling is assembled substantially in its entirety.*

37. [The manufacturing facility of claim 36 wherein said plurality of subassembly production lines further comprises:] *A manufacturing facility for constructing standard size, non-roadable dwellings, having length and width dimensions, substantially in their entirety in said manufacturing facility, said manufacturing facility being located proximate a location at which standard size dwellings produced in said manufacturing facility are to be sited after exiting said manufacturing facility, and comprising:*

*a plurality of subassembly production lines, at least two of said plurality of subassembly production lines providing means for constructing predetermined subassemblies of said standard size dwelling, each of said predetermined subassemblies comprising a structural section of said standard size dwelling, from the class of structural sections consisting of: walls, floors, roof trusses, roof, and foundation base frame, wherein said plurality of subassembly production lines are oriented substantially parallel to and juxtaposed to at least one other subassembly production line and orthogonal to a swelling assembly alley, said plurality of subassembly production lines comprise:*

*a first of said subassembly production lines for constructing a floor subassembly comprising an integral base frame from placement on said transport element, which is located in said dwelling assembly alley,*

*a second of said subassembly production lines, located adjacent said first subassembly production line, for constructing a plurality of panelized wall assemblies for assembly on to said floor subassembly located on said transport element, which is located in said assembly alley to produce a partially assembled standard size dwelling,* a third of said subassembly production lines, located adjacent said second subassembly production line, for constructing [a] second story wall assemblies for assembly on to said partially assembled standard size dwelling located on said transport element, which is located in said dwelling assembly alley; [and a fourth of said subassembly production lines, located adjacent said third subassembly production line, for constructing a roof subassembly for assembly on to said partially assembled standard size dwelling which is located on said transport element located in said dwelling assembly alley]

*a dwelling assembly alley located substantially proximate to said at least two subassembly production lines for providing a site for assembling a partially assembled standard size dwelling therein;*

*hoisting means operational in said at least two subassembly production lines for transporting said constructed predetermined subassemblies from said at least two subassembly production lines to said dwelling assembly alley to install said constructed predetermined subassemblies into a partially assembled standard size dwelling located therein, which partially assembled standard size dwelling is non-roadable by having at least one of the dimensional characteristics: the smaller of said length and width dimensions being greater than 16 feet and being greater than one story in height; and*

*wherein said dwelling assembly alley provides a transport element for transporting said partially assembled standard size dwelling while said standard size dwelling is assembled from said predetermined subassemblies by respectively incorporating said predetermined subassemblies into said partially assembled standard size dwelling using said hoisting means when said partially assembled standard size dwelling is positioned in said assembly alley opposite a corresponding one of said*

*plurality of subassembly production lines until said partially assembled standard size dwelling is assembled substantially in its entirety.*

38. The manufacturing facility of claim [36] *37* wherein said plurality of subassembly production lines further comprises:

a roofing subassembly production line, for constructing a roof subassembly for assembly on to said partially assembled standard size dwelling located on said transport element, which is located in said dwelling assembly alley.

39. A manufacturing facility for constructing standard size dwellings substantially in their entirety, said manufacturing facility being located proximate a location at which standard size dwellings are to be sited, comprising:

a foundation assembly production line for constructing an integral foundation base frame that supports load bearing walls of said standard size dwelling;

at least two subassembly production lines for constructing predetermined subassemblies for said standard size dwelling, each of said predetermined subassemblies comprising a structural section of said standard size dwelling, from the class of structural sections consisting of: walls, floors, *and* roof, *comprising:*

*a load bearing wall subassembly production line for assembly of load bearing wall subassemblies for incorporation into said partially assembled standard size dwelling by structural attachment to said integral foundation base frame,*

*a second story subassembly production line, located adjacent said load bearing wall subassembly production line, for constructing second story wall assemblies*;

a dwelling assembly alley located substantially proximate to said at least two subassembly production lines for assembling a partially assembled standard size dwelling therein using said predetermined subassemblies, which incorporated into said partially assembled standard size dwelling until said partially assembled standard size dwelling is assembled substantially in its entirety; and housing means operational in each of said at least two subassembly production lines for transporting said constructed predetermined subassemblies to said dwelling assembly alley for incorporation into a partially assembled standard size dwelling being assembled therein, with said hoisting means transporting at least a subset of load bearing ones of said predetermined subassemblies for direct connection to said integral foundation base frame.

* * * * *